US008753089B2

(12) United States Patent
Iwai

(10) Patent No.: US 8,753,089 B2
(45) Date of Patent: Jun. 17, 2014

(54) TURBINE ROTOR ASSEMBLY AND STEAM TURBINE

(75) Inventor: Masahiko Iwai, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 615 days.

(21) Appl. No.: 13/043,974

(22) Filed: Mar. 9, 2011

(65) Prior Publication Data

US 2011/0223012 A1 Sep. 15, 2011

(30) Foreign Application Priority Data

Mar. 10, 2010 (JP) ..... 2010-052776

(51) Int. Cl.
*F04D 29/34* (2006.01)

(52) U.S. Cl.
USPC ..... 416/212 A; 416/215; 416/220 R

(58) Field of Classification Search
USPC ..... 415/193, 194, 195; 416/212 A, 215, 416/216, 217, 219 R, 220 R
See application file for complete search history.

(56) References Cited

U.S. PATENT DOCUMENTS 3,006,603 A * 10/1961 Caruso et al. ..... 415/195
4,730,984 A * 3/1988 Ortolano ..... 416/222
5,511,948 A * 4/1996 Suzuki et al. ..... 416/191
7,261,518 B2 * 8/2007 Golinkin et al. ..... 416/215
7,306,433 B2 * 12/2007 Klingels et al. ..... 416/216
2006/0275127 A1 * 12/2006 Borufka et al. ..... 416/203

FOREIGN PATENT DOCUMENTS

JP 62-038802 A 2/1987
JP 07-279606 A 10/1995
JP 2000-220405 A 8/2000

OTHER PUBLICATIONS

"Turbine Steam Path Mechanical Design and Manufacture", vol. IIIb, Sanders, William P. Pennwell Corp., 2004, ISBN 1-59370-010-5, pp. 616-660.

* cited by examiner

*Primary Examiner* — Edward Look
*Assistant Examiner* — Aaron R Eastman
(74) *Attorney, Agent, or Firm* — Foley & Lardner LLP

(57) ABSTRACT

A turbine moving blade cascade 30 of a turbine rotor assembly 35 has root portions of plural moving blades 13 fitted and held in a root groove circumferentially formed on the outer circumferential portion of a rotor disk 15 of a turbine rotor 14 and has a notch blade 40 fixed in a cutout portion formed in the rotor disk 15. The plural moving blades 13 are comprised of three types of moving blades which include regular blades 50 having a circumferential width determined through theoretical calculation, wide blades 51 having a circumferential width larger than the regular blades 50, and narrow blades 52 having a circumferential width smaller than the regular blades 50.

6 Claims, 23 Drawing Sheets

TURBINE ROTOR ASSEMBLY AND STEAM TURBINE

CROSS-REFERENCE TO RELATED APPLICATIONS

This application is based upon and claims the benefit of priority from Japanese Patent Application No. 2010-052776, filed on Mar. 10, 2010; the entire contents of which are incorporated herein by reference.

FIELD

Embodiments described herein relate generally to a turbine rotor assembly and a steam turbine provided with the turbine rotor assembly.

BACKGROUND

The turbine rotor assembly of the steam turbine is configured by, for example, inserting moving blades one by one along a circumferential direction from a notch groove formed in a root portion of a rotor disk formed along a circumferential direction of a turbine rotor, and lastly fixing a tightening part such as a notch blade.

The tightening part is being devised in various ways from various viewpoints such as mechanical strength, turbine efficiency, and weight balance. For example, since the tightening part is fixed to the notch groove formed in the root portion of the rotor disk, it does not have a root portion. Therefore, a load is applied to the moving blades on both sides of the tightening part to maintain the assembled state against, for example, a centrifugal force applied to the tightening part. Accordingly, it is preferable that the tightening part's weight is reduced as low as possible in order to reduce the load applied to the both-side moving blades as small as possible.

As the tightening part, there are used, for example, a stopper of which weight is maximally reduced, a stopper block having a structure of the root portion only with an effective blade part and the like removed, a notch blade having the same blade portion as other moving blades, and the like. And, an appropriate one is selected to use from the above tightening parts depending on the strength design and the like of turbine stages.

The above tightening parts have a weight different from the moving blades which mainly configure a turbine moving blade cascade and are formed based on theoretical calculation, so that the more the weight is reduced, the more the weight balance is lost as the turbine moving blade cascade. Therefore, it is also necessary to have moving blades for weight adjustment, so that the tightening part does not become a vibration generating source of the turbine rotor.

Meanwhile, further improvement of performance of the steam turbine is demanded for prevention of global warming. For example, to prevent a stage loss from increasing, there is a tendency to adopt the notch blade as the tightening part without adopting the stopper block not having a steam passage portion. And, it is also tried to use titanium or the like to produce the notch blade. One of the advantages to use titanium as a material for the notch blade is light weight that the weight is about 60% of iron and steel type material. But, the titanium also has disadvantages that its processability is bad and it is expensive.

The structure of a conventional turbine moving blade cascade is described below.

First, a conventional turbine moving blade cascade having a stopper block as a tightening part is described.

FIG. 22 is a schematic view of a conventional turbine moving blade cascade 400 having a stopper block 410 as a tightening part as viewed from the upstream side in a turbine rotor axial direction. FIG. 23 is a plan view of the stopper block 410 as viewed from the circumferential direction. FIG. 24 is a partial magnified view of the turbine moving blade cascade 400 having the stopper block 410. FIG. 25 is an exploded perspective view showing a mounting state of the stopper block 410. FIG. 26 is a plan view of a moving blade provided with a groove 415 for adjustment of a weight balance as viewed from the circumferential direction. FIG. 22 shows numbers corresponding to the quantity of implanted moving blades 411.

The turbine moving blade cascade 400 shown in FIG. 22 has 147 moving blades 411 disposed in the circumferential direction excepting the stopper block 410. As shown in FIG. 23, the stopper block 410 has a structure with only a root portion from which an effective blade part and the like are removed and is fixed between the moving blades 411 as shown in FIG. 24.

As shown in FIG. 25, plural root grooves 421 are circumferentially formed on both side surfaces of the outer circumferential portion of a rotor disk 420, and hook portions 411*b* formed on a root portion 411*a* of the moving blade 411 are fitted into the root grooves 421 of the rotor disk 420. The moving blade 411 is inserted via a cutout portion 422 formed in the rotor disk 420 and fitted with the root grooves 421 of the rotor disk 420.

As shown in FIG. 24 and FIG. 25, the stopper block 410 positioned at the cutout portion 422 is fixed by inserting a key 413 into holes 412 which are formed by key grooves 412*a* and 412*b* formed in a root portion 410*a* of the stopper block 410 and root portions 411*a* of the adjacent moving blades 411 in parallel to the turbine rotor axial direction. Thus, a centrifugal force applied to the stopper block 410 is supported by the adjacent moving blades 411 via the keys 413 to prevent the stopper block 410 from coming out.

When the stopper block 410 is provided in the turbine moving blade cascade 400, a weight balance is generally adjusted by reducing the weight of the moving blade which is arranged at a position symmetrical to the stopper block 410 with respect to the turbine rotor central axis.

The easiest method of adjusting the weight balance is to have a counter moving blade (moving blade positioned symmetrical about a point to the stopper block 410 with respect to the turbine rotor central axis) formed to have the same shape as the stopper block 410. But, the adoption of the above structure is not preferable because the steam passage portion is lost at two points on the circumference, and the performance decreases. Therefore, the weight balance of the conventional turbine moving blade cascade 400 is adjusted by locally fabricating the moving blades (e.g., Nos. 59 to 88 in FIG. 22) positioned on the side symmetrical to the stopper block 410 with respect to the turbine rotor central axis, namely, by forming the groove 415 to adjust the weight as shown in FIG. 26. The moving blades of which weights are adjusted by forming the groove 415 are called the weight-reduced moving blades hereinafter.

A conventional turbine moving blade cascade provided with a notch blade as a tightening part is described below.

FIG. 27 is a schematic view of a conventional turbine moving blade cascade 401 having a notch blade 440 as a tightening part as viewed from the upstream side in a turbine rotor axial direction. The fixing method of the notch blade 440 is basically same to the previously described fixing method of the stopper block 410, but when the notch blade 440 is used, pin holes are formed in the root portion of the notch blade 440 and the rotor disk, and locking pins are inserted into the pin holes so that it is configured to completely prevent the notch blade 440 from being floated up by a centrifugal force.

As described above, there is a tendency to adopt the notch blade as the tightening part to prevent a stage loss from increasing. Here, when design and manufacture are performed considering from the beginning a structure that, for example, 148 moving blades 411 (including the notch blade 440) are provided on the whole circumference, the weight balance can be adjusted easily. But, for example, when the structure having the stopper block as the tightening part is made to have a structure adopting the notch blade as the tightening part by an afterward design change or structure change, it cannot be performed easily because the weight balance must be adjusted considering the original state of the weight balance.

For example, in a case that a newly manufactured notch blade 440 is formed of the same iron and steel type material as the moving blades 411, countermeasures are considered after an unbalanced amount is reduced by fully replacing the weight-reduced moving blades used when the stopper block 410 is provided as the above-described tightening part by the regular moving blades 411. As one measure to reduce the unbalanced amount due to the provision of the notch blade 440, the notch blade 440 is formed of titanium, and some moving blades (e.g., Nos. 70 to 78 in FIG. 27) positioned on a side (hereinafter called the counter side) symmetrical to the notch blade 440 about a point with respect to the turbine rotor central axis are determined to be weight-reduced moving blades to adjust the weight balance.

As described above, when the stopper block or the notch blade is adopted as the tightening part in the conventional turbine moving blade cascade, plural weight-reduced moving blades are arranged on the counter side to adjust the weight balance. The weight-reduced moving blade is configured to have the groove in the moving blade as described above, but the groove cannot be formed to have a large size because of strength constraint. Therefore, the amount of the weight reduction is small even when the regular moving blade is replaced by the weight-reduced moving blade. Thus, it is necessary to arrange a large number of weight-reduced moving blades on the counter side.

When the design conditions for the moving blades are strictly restricted in view of strength, use of the weight-reduced moving blades might not be allowed. In such a case, it is necessary to adopt the stopper block as the tightening part or to adopt as the counter moving blade the moving blade having the same shape as the stopper block, and the design becomes to increase the stage loss.

DETAILED DESCRIPTION

In one embodiment, a turbine rotor assembly comprises a turbine rotor; a root groove circumferentially provided around an outer circumferential surface of the turbine rotor; and a plurality of moving blades, each of which comprising a root member coupled with the root groove. The moving blades comprise a regular blade, the root member of which has a circumferential width determined based upon a circumferential length of the outer surface of the turbine rotor and a number of the moving blades coupled with the root groove; a wide blade, the root member of which has a circumferential width wider than the regular blade; and a narrow blade, the root member of which has a circumferential width narrower than the regular blade.

Embodiments according to the invention are described below with reference to the drawings.

(First Embodiment)

Figure 1:
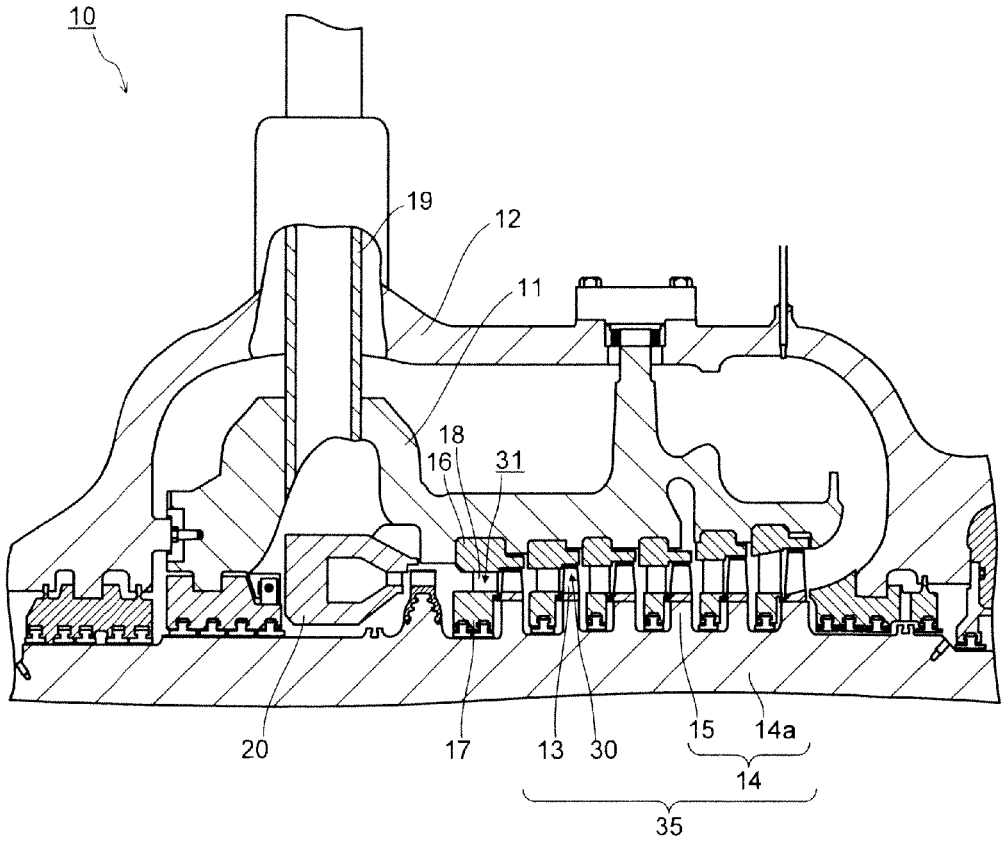
FIG. 1 is a view showing a cross section (meridional cross section) of a steam turbine provided with the turbine rotor assembly according to a first embodiment including the center line of a turbine rotor.

FIG. 1 is a view showing a cross section (meridional cross section) including the center line of a turbine rotor 14 of a steam turbine 10 provided with a turbine rotor assembly 35 of a first embodiment according to the invention.

As shown in FIG. 1, the steam turbine 10 is provided with, for example, a double-structured casing comprising an inner casing 11 and an outer casing 12 which is disposed outside thereof. And, the turbine rotor assembly 35 is disposed in the inner casing 11. The turbine rotor assembly 35 is provided with the turbine rotor 14. FIG. 1 exemplifies as the turbine rotor 14, one comprising a turbine shaft 14*a* and rotor disks 15 which are formed in plural stages in a turbine rotor axial direction of the turbine shaft 14*a*. The rotor disks 15 are formed to have root grooves for implanting the moving blades 13. In addition, the turbine rotor assembly 35 has the plural moving blades 13, which are implanted in a circumferential direction, in the root grooves of the rotor disks 15. A turbine moving blade cascade 30 is comprised of the plural moving blades 13 implanted in the circumferential direction. The turbine rotor 14 also includes one which is comprised of the turbine shaft 14*a* not having the rotor disk 15. In such a case, the root grooves for implanting the moving blades 13 are formed in the outer circumference of the turbine shaft 14*a*.

And, plural nozzles 18 are circumferentially supported between a diaphragm outer ring 16 and a diaphragm inner ring 17 on the inner circumferential side of the inner casing 11 to configure a nozzle blade cascade 31. The nozzle blade cascade 31 is disposed on the upstream side of each turbine moving blade cascade 30 to configure a turbine stage by the nozzle blade cascade 31 and the turbine moving blade cascade 30.

The steam turbine 10 also has a steam inlet pipe 19 disposed through the outer casing 12 and the inner casing 11, and an end of the steam inlet pipe 19 is connected to communicate with a nozzle box 20.

In the steam turbine 10 configured as described above, steam entering the nozzle box 20 via the steam inlet pipe 19 performs expansion work while passing through the individual turbine stages to rotate the turbine rotor 14. The steam having performed the expansion work is discharged to flow into, for example, a boiler (not shown) through a low-temperature reheating pipe (not shown).

A structure of the turbine rotor assembly 35 of the first embodiment is described below.

Described below are (1) use of a notch blade as the tightening part from the beginning of the design and (2) use of a notch blade as the tightening part after a later design change of a structure provided with a stopper block as the tightening part in the turbine moving blade cascade 30 of the turbine rotor assembly 35.

Figure 2:
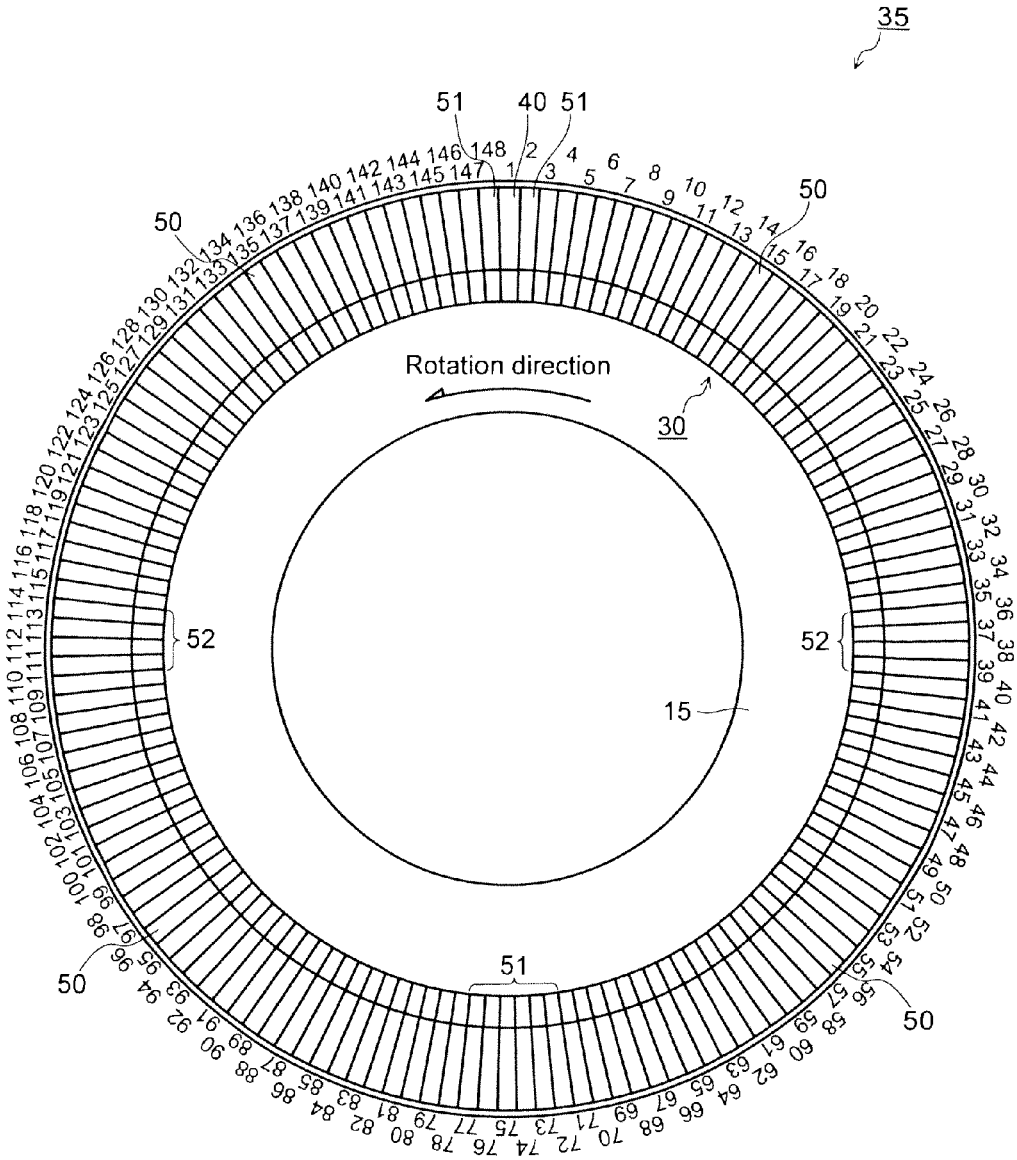
FIG. 2 is a schematic view of a turbine rotor assembly having a notch blade as a tightening part according to the first embodiment as viewed from the upstream side in a turbine rotor axial direction.
Figure 3:
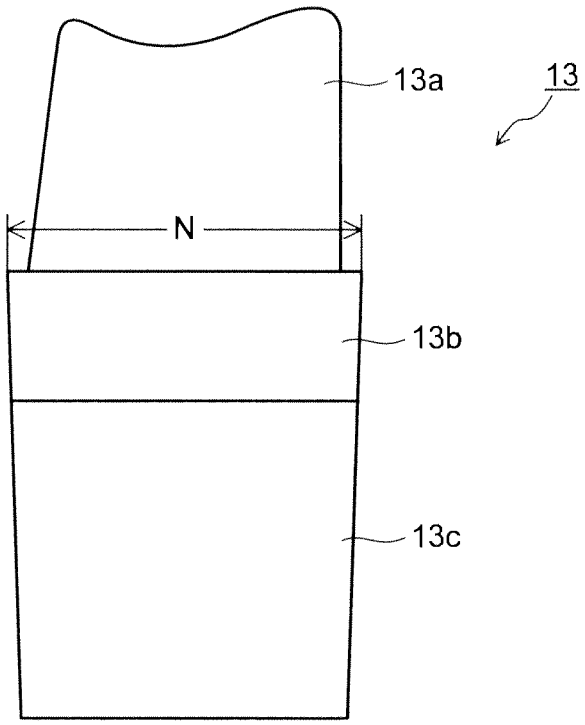
FIG. 3 is a schematic view of a regular blade viewed from the upstream side in the turbine rotor axial direction to describe a circumferential width of a moving blade according to the first embodiment.

(1) Use of Notch Blade 40 as the Tightening Part from the Beginning of the Design FIG. 2 is a schematic view of the turbine rotor assembly 35 of the first embodiment having the notch blade 40 as the tightening part as viewed from the upstream side in the turbine rotor axial direction. FIG. 2 shows Nos. corresponding to the quantity of the implanted moving blades 13 (including the notch blade 40). In FIG. 2, the moving blades other than the notch blade 40, wide blades 51 and narrow blades 52 are regular blades 50. FIG. 3 is a schematic view of the regular blade 50 as viewed from the upstream side in the turbine rotor axial direction to describe a circumferential width of the moving blade 13 according to the first embodiment.

Figure 24:
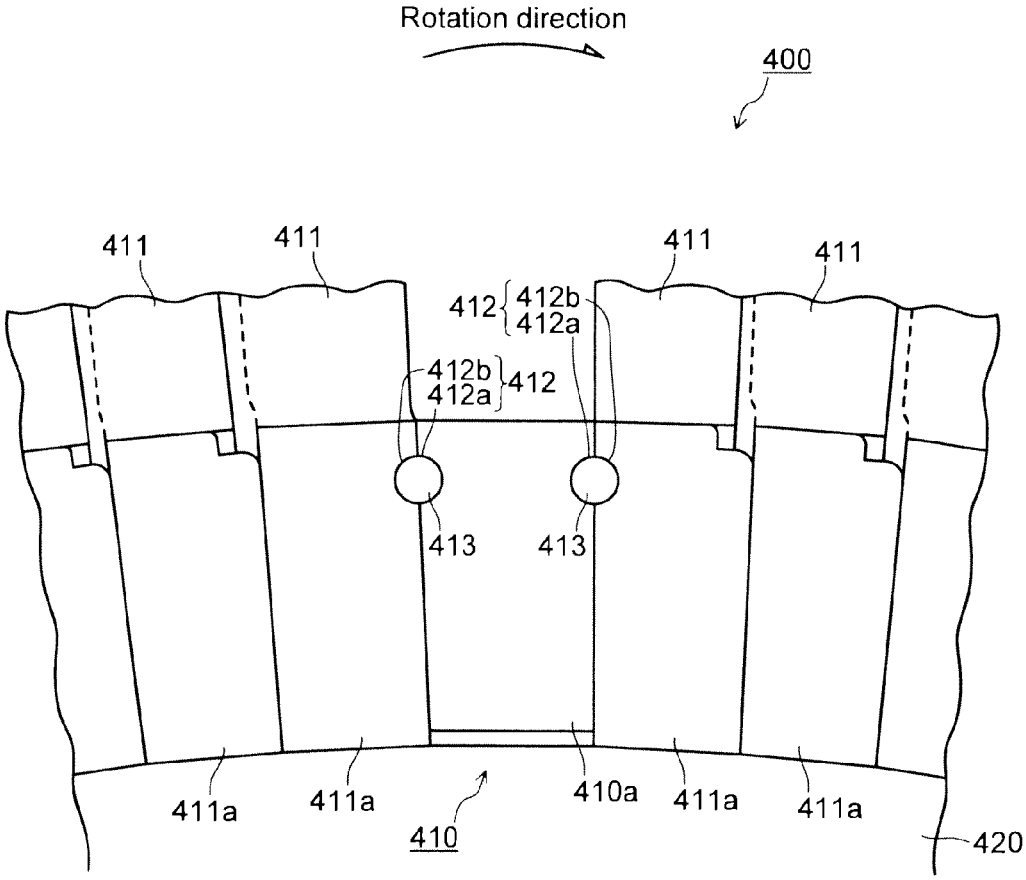
FIG. 24 is a magnified view of a portion having a stopper block of a conventional turbine moving blade cascade.
Figure 25:
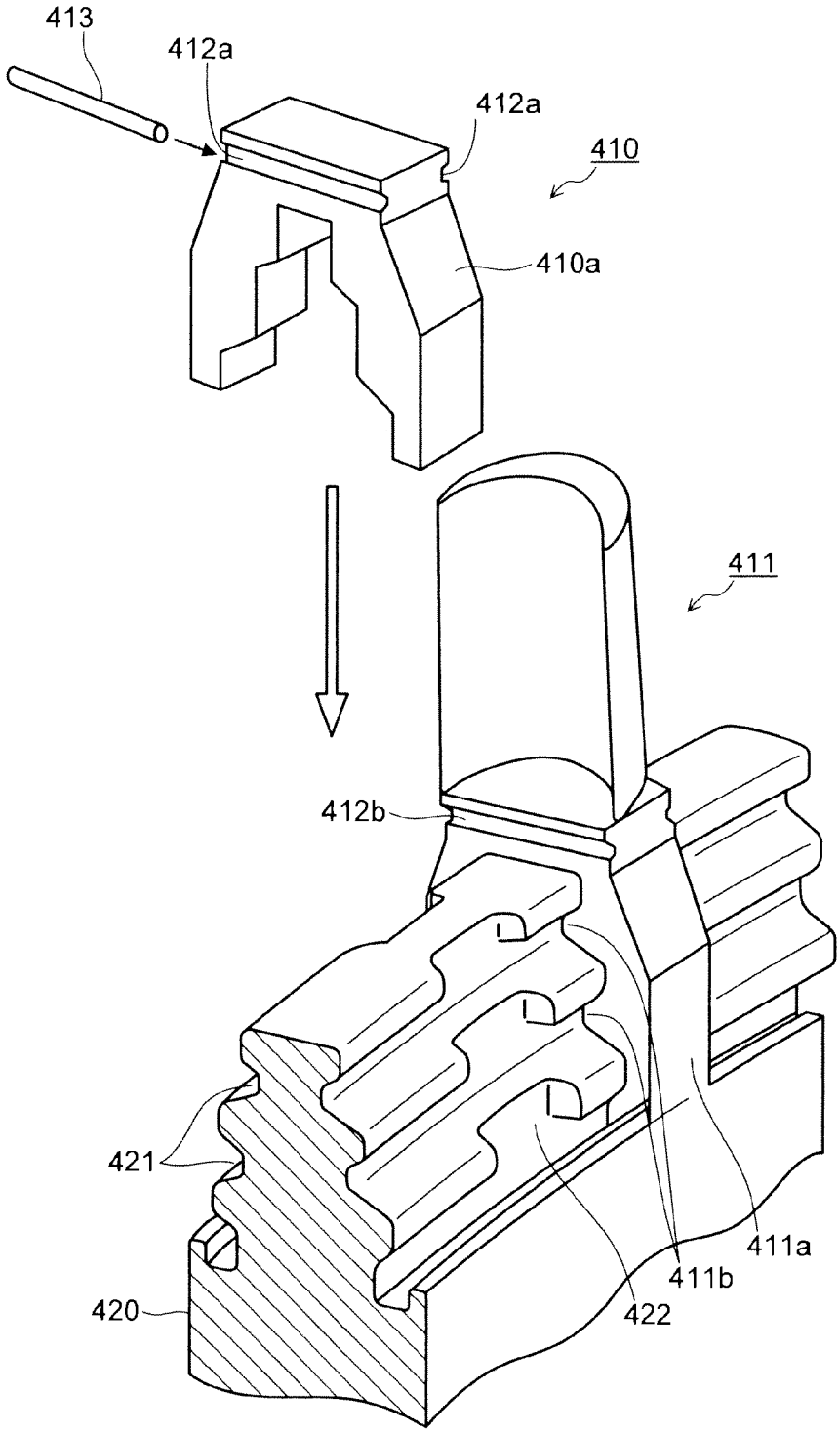
FIG. 25 is an exploded perspective view showing a conventional stopper block mounting state.
Figure 26:
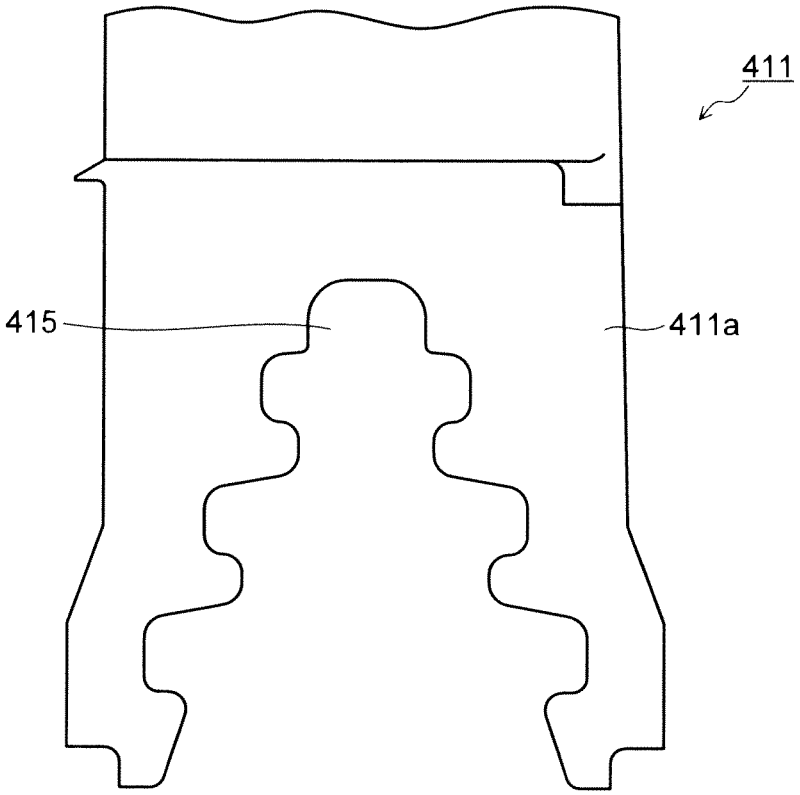
FIG. 26 is a plan view of a conventional moving blade provided with a groove for adjustment of a weight balance as viewed from its circumferential direction.
Figure 27:
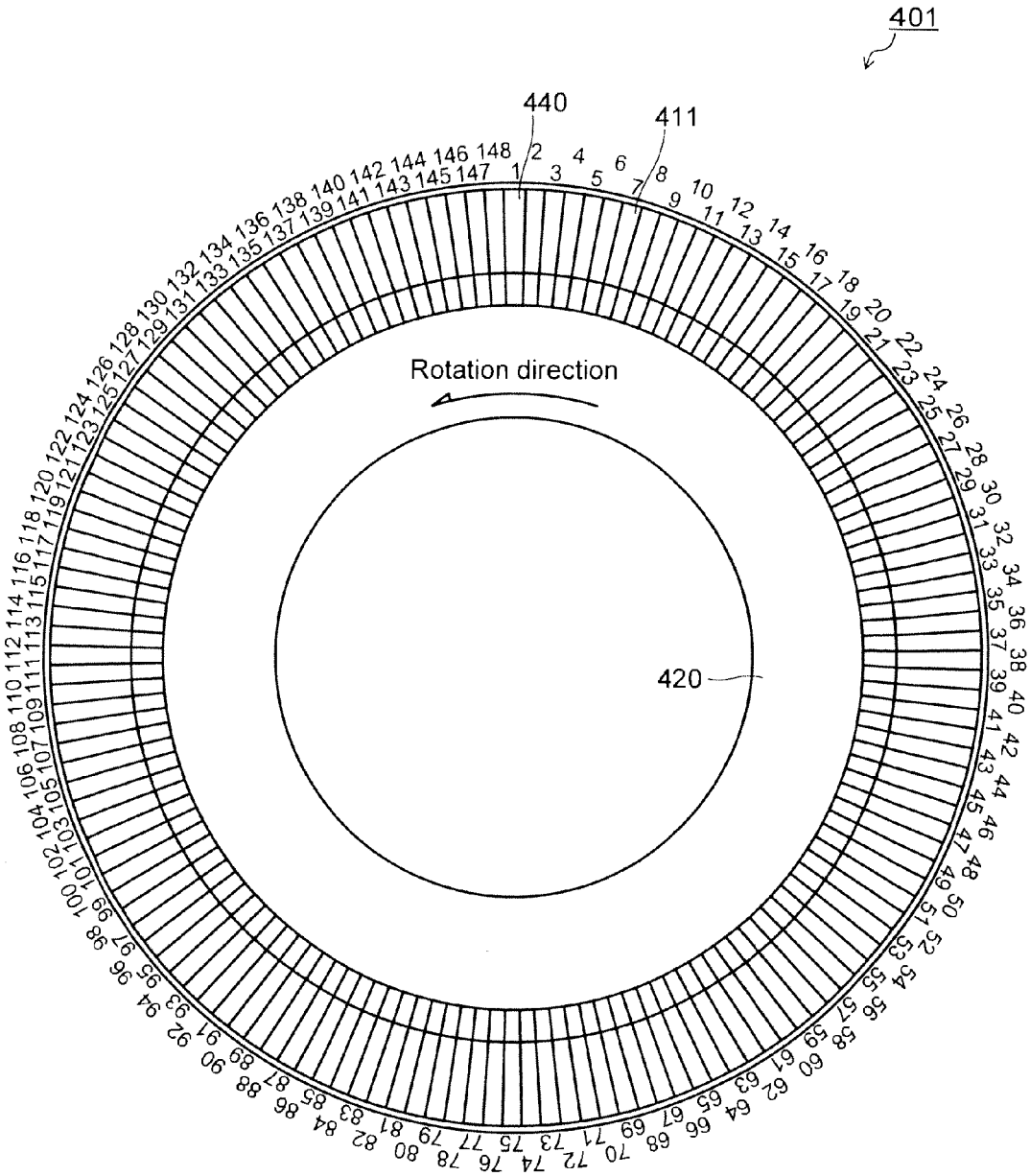
FIG. 27 is a schematic view of a conventional turbine moving blade cascade having a notch blade as a tightening part as viewed from the upstream side in the turbine rotor axial direction.

The notch blade 40 and 147 moving blades 13 are circumferentially disposed in the turbine moving blade cascade 30 of the turbine rotor assembly 35 shown in FIG. 2. The mounting method of the moving blades 13 and the fixing method of the notch blade 40 are same as the previously described method shown in FIG. 24 and FIG. 25.

As shown in FIG. 2, the turbine moving blade cascade 30 has three types of moving blades 13 which are the regular blades 50 having blade width N in the circumferential direction determined based on theoretical calculation, the wide blades 51 having blade width L in the circumferential direction larger than the blade width N of the regular blades 50, and the narrow blades 52 having blade width S in the circumferential direction smaller than the blade width N of the regular blades 50.

Here, a circumferential width of the root member of the regular blade 50 is determined based upon a circumferential length of the outer surface of the turbine rotor 14 and a number of the moving blades 13 coupled with the root groove of the turbine rotor 14. For example, the circumferential width of the regular blade 50 can be determined based on the angle obtained by dividing the angle, which is obtained by subtracting an angle corresponding to the circumferential width of the notch blade 40 from the whole circumference angle (that is 360°), by the quantity of the regular blades 50 through theoretical calculation. And, the circumferential width of the moving blade 13 (regular blade 50) is a circumferential blade width N of a shank portion 13*b* formed between an effective blade part 13*a* and an root portion 13*c* at an end on the side of the effective blade part 13*a* as shown in FIG. 3. As to the wide blade 51, the narrow blade 52 and the notch blade 40, the circumferential width is defined in the same manner.

And, the circumferential blade width of the wide blade 51 and the narrow blade 52 at the shank portion or the root portion is different from that of the regular blade 50, but the effective blade part and the shroud of the wide blade 51 and the narrow blade 52 have the same structures as that of the regular blade 50. Therefore, the weight difference of the above moving blades depends on the difference of the circumferential blade width at the shank portion or the root portion. And, the weight per unit length of the circumferential width of the moving blade is large in order of the narrow blade 52, the regular blade 50, and the wide blade 51 (narrow blade 52>regular blade 50>wide blade 51).

For example, a weight adjustment amount per one wide blade 51 is larger than the weight adjustment amount per one weight-reduced moving blade of which weight is adjusted by forming the groove as described above. Therefore, the weight balance can be adjusted by a small number of the wide blades 51.

Adjustment of the circumferential width and the weight balance is described below.

In FIG. 2, when the notch blade 40 having circumferential blade width C is arranged instead of the regular blade 50 at No. 1, an increase in circumferential width of the turbine moving blade cascade 30 is calculated by "C-N". The blade width C of the notch blade 40 is larger than the blade width N of the regular blade 50. And, to control the weight balance in connection with the increase in width, the regular blade 50 on the counter side, which is symmetrical to the notch blade 40 about a point with respect to the turbine rotor central axis, is replaced by the number a of the wide blades 51, so that the weight balance can be basically adjusted by satisfying the following equation (1).

$$C-N=a\times(L-N) \quad (1)$$

The value a is determined by a difference (L−N) (hereinafter called as ΔL) between the blade width L of the wide blade 51 and the blade width N of the regular blade 50, and the value a is assumed to be 4 here.

The centrifugal force of the notch blade 40 is applied to the moving blades 13 on both sides of the notch blade 40. Accordingly, when the moving blades 13 on both sides of the notch blade 40 are determined to be the wide blades 51, a stress at the root portions of the moving blades 13 can be reduced. Therefore, the moving blades 13 on both sides of the notch blade 40 are determined to be the wide blades 51.

When the moving blades 13 on both sides of the notch blade 40 are determined to be the wide blades 51, it is also necessary to add two wide blades 51 on the counter side to adjust the weight balance of the two added wide blades 51. As a result, six wide blades 51 are arranged on the counter side (Nos. 72 to 77), and a total of eight wide blades 51 are arranged along the circumference of the turbine moving blade cascade 30. When the eight regular blades 50 are replaced by the eight wide blades 51, the circumferential length is increased virtually by "8×ΔL". To decrease the increment in the circumferential length, the narrow blades 52 are used instead of the other regular blades 50.

When it is assumed that a difference (N−S) (hereinafter called as ΔS) between the blade width N of the regular blade 50 and the blade width S of the narrow blade 52 is equal to ΔL, eight narrow blades 52 are arranged on the circumference of the turbine moving blade cascade 30 so that the weight balance is not lost. FIG. 2 shows an example in that four narrow blades 52 are respectively arranged at positions of ±90° from the position of the notch blade 40 and positions (Nos. 36 to 39 and Nos. 111 to 114) near them.

As described above, in a case where the notch blade 40 is used as the tightening part from the beginning of the design, the weight balance can be adjusted easily by replacing the regular blades 50 partly by the wide blades 51 or the narrow blades 52. The above-described weight balance adjusting method is one example and not limited to the example.

In the above-described example, ΔL and ΔS are equal to each other, but it is preferable that a value (ΔL/ΔS) obtained by dividing ΔL by ΔS becomes a natural number. Since a ratio of numbers of the wide blades 51 and the narrow blades 52 can be simplified by having the above relationship, the weight balance can be adjusted practically and easily.

For example, when ΔL/ΔS is 1, it corresponds to the above case that ΔL and ΔS are equal to each other. And, when ΔL/ΔS is 2 or 3, it is necessary to provide two or three narrow blades 52 in order to decrease the increase ΔL of the blade width by one wide blade 51. And, when ΔL/ΔS is 2 or 3, the stress of the root portion becomes ½ or ⅓ of the stress of the root portion when ΔL/ΔS is 1, so that the value ΔL/ΔS can be determined depending on the stress level of the root portion.

When ΔL/ΔS is 4 or more, the stress of the root portion becomes ¼ of the stress of the root portion when ΔL/ΔS is 1, and it is preferable from a view point of the stress. But, it is necessary to have four narrow blades 52 in order to decrease the increase ΔL of the blade width due to the one wide blade 51, and there is a tendency that the adjustment of the weight balance becomes troublesome. Therefore, though ΔL/ΔS can be set to 4 or more, it is preferable to set to 3 or less from a view point of reducing the quantity of the wide blades 51 or the narrow blades 52.

The blade width L of the wide blade 51 is preferably set to 1.05 times or less the blade width N of the regular blade 50. Namely, the blade width L of the wide blade 51 is preferably set to be larger than one time the blade width N of the regular blade 50 and 1.05 times or less the blade width N of the regular blade 50.

Reasons for the above are described below. The wide blade 51 supports the same effective blade part as the regular blade 50 by a root portion having the circumferential blade width larger by ΔL than the regular blade 50, so that the stress based on the centrifugal force of the root portion becomes lower than that of the regular blade 50. Therefore, there is no problem even if ΔL is set to a large value from a view point of the stress. But, the contact width of the hook of the root portion becomes smaller by ΔL because the wide blade 51 is also inserted from the notch groove formed in the root portion of the rotor disk of the turbine rotor similar to the regular blade 50. Therefore, it is not preferable when the blade width L of the wide blade 51 exceeds 1.05 times the blade width N of the regular blade 50. And, a steam flow disturbance generated when the distance between the neighboring moving blades increases can also be suppressed by setting the blade width L of the wide blade 51 to 1.05 times or less the blade width N of the regular blade 50.

It is also preferable that the blade width S of the narrow blade 52 is set to 0.95 time or more the blade width N of the regular blade 50. Namely, it is preferable to set the blade width S of the narrow blade 52 to be smaller than one time the blade width N of the regular blade 50 and to 0.95 time or more the blade width N of the regular blade 50.

Reasons for the above are described below. The narrow blade 52 supports the same effective blade part as the regular blade 50 by a root portion having a circumferential blade width smaller by ΔS than the regular blade 50, so that the stress based on the centrifugal force of the root portion becomes larger than that of the regular blade 50. Generally, it is necessary to minimize an increased amount of a working stress of the root portion of the moving blade because it is often designed to make an allowance for allowable stress small. And, when the blade width S of the narrow blade 52 becomes small, there is also a structural restriction, so that it is not preferable to make the blade width S of the narrow blade 52 smaller than 0.95 time the blade width N of the regular blade 50.

Figure 4:
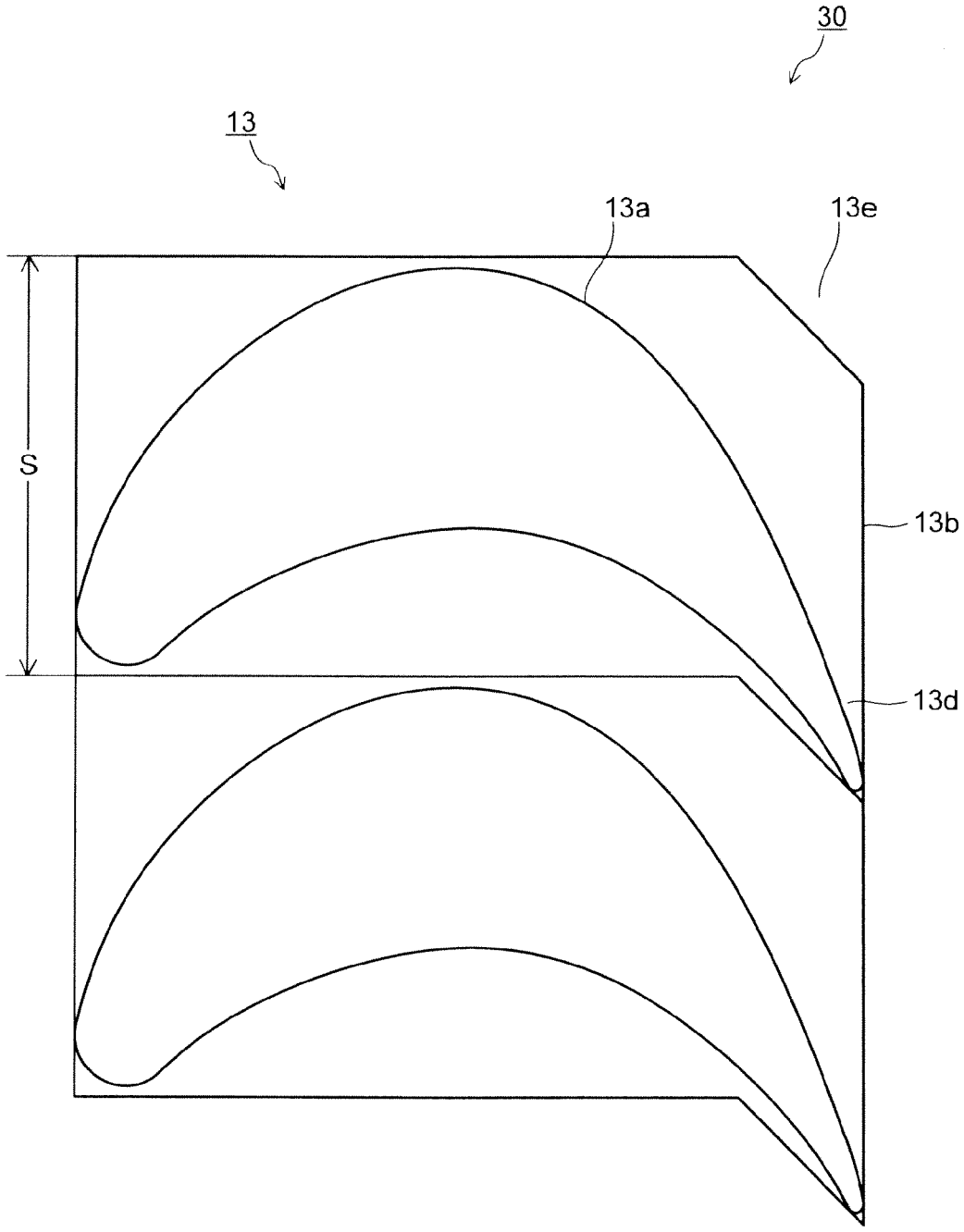
FIG. 4 is a developed view showing a circumferential cross section of a narrow blade configuring the turbine moving blade cascade according to the first embodiment.
Figure 5:
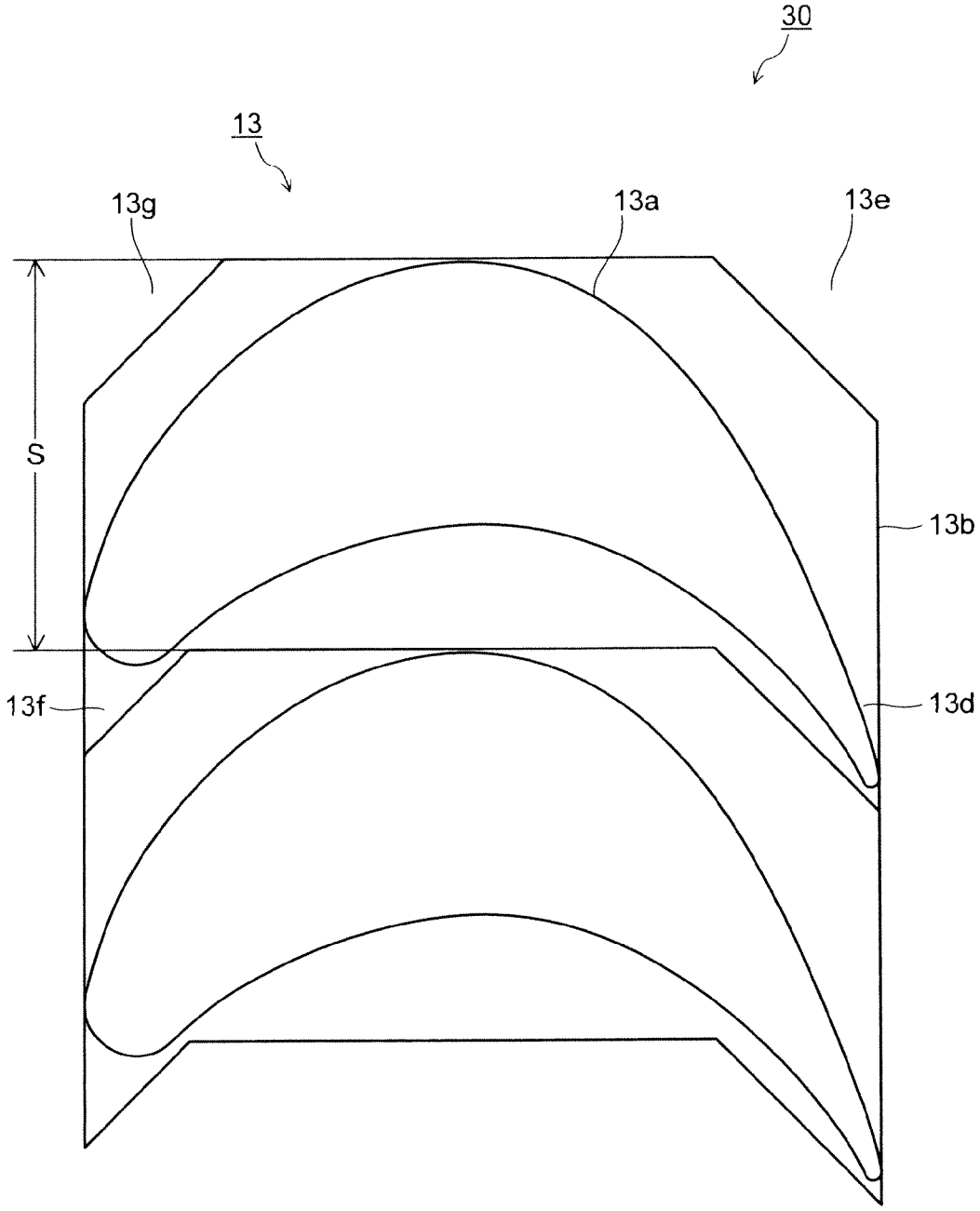
FIG. 5 is a developed view showing a circumferential cross section of a narrow blade having a blade width S smaller than the blade width S shown in FIG. 4 according to the first embodiment.

FIG. 4 is a developed view showing a circumferential cross section of the narrow blade 52 configuring the turbine moving blade cascade 30 according to the first embodiment. FIG. 5 is a developed view showing a circumferential cross section of the narrow blade 52 having the blade width S smaller than the blade width S shown in FIG. 4 according to the first embodiment.

For example, in the moving blades 13 of the turbine moving blade cascade 30 configuring a low-pressure turbine stage, a trailing edge of the effective blade part 13*a* is formed to protrude from the shank portion 13*b* as shown in FIG. 4. In view of the assembling requirements, it is general to form an overhanging portion 13*d* and a notch groove portion 13*e* corresponding to the overhanging portion 13*d* at one end of the shank portion 13*b* as shown in FIG. 5. But, when the blade width S of the narrow blade 52 becomes narrower, the leading edge of the effective blade part 13*a* is formed to protrude from the shank portion 13*b* as shown in FIG. 5. And, in view of the assembling requirements, an overhanging portion 13*f* and a notch portion 13*g* corresponding to the overhanging portion 13*f* are formed at the other end of the shank portion 13*b* in the same manner as the former end as shown in FIG. 4. Therefore, the steps of fabricating the moving blades 13 increase substantially. In addition, when the blade width S of the narrow blade 52 becomes small, the distance between the neighboring moving blades 13 becomes small, and steam flow characteristics might be changed. Therefore, the blade width S of the narrow blade 52 is preferably determined to be 0.95 time or more the blade width N of the regular blade 50.

Figure 6:
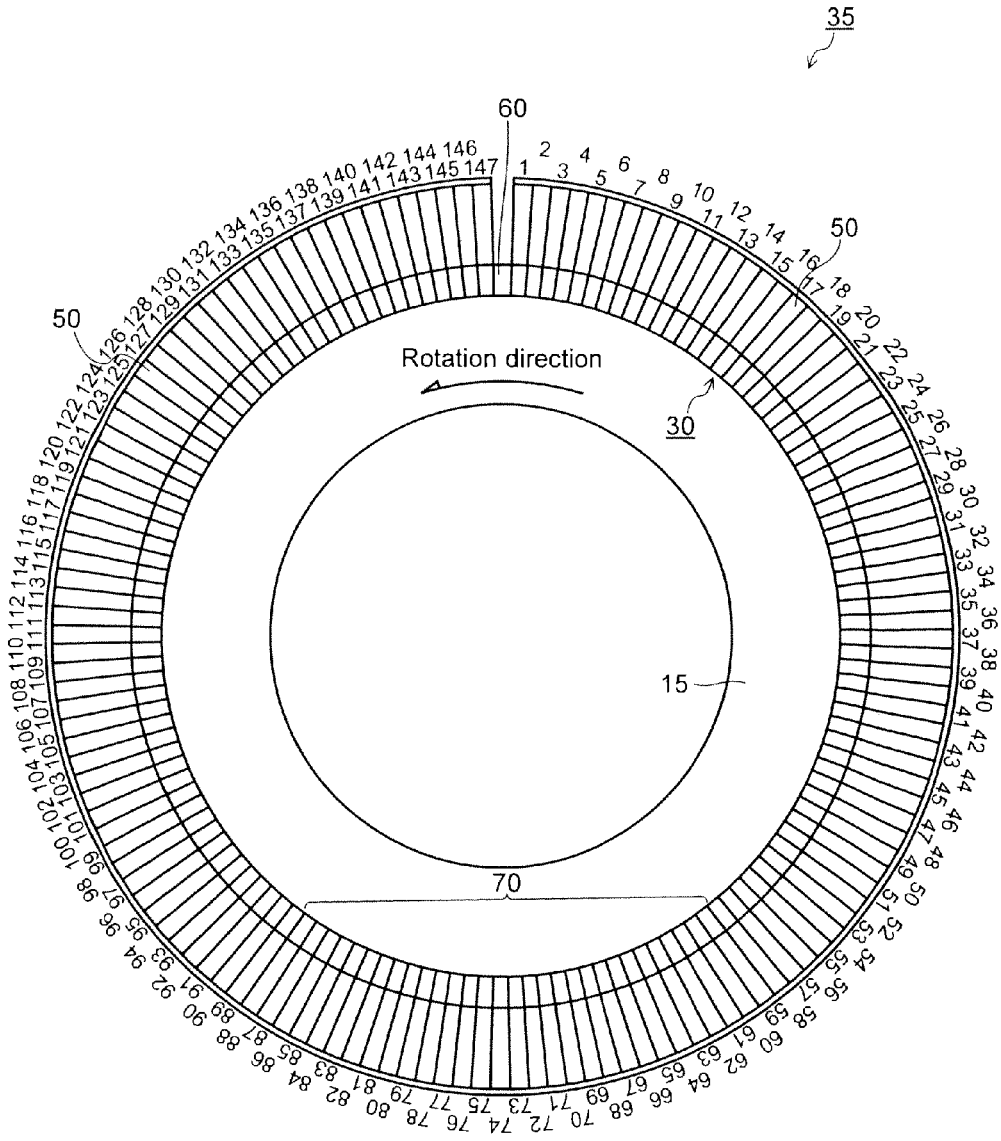
FIG. 6 is a schematic view of the turbine rotor assembly provided with a stopper block as a tightening part according to the first embodiment as viewed from the upstream side in the turbine rotor axial direction.
Figure 7:
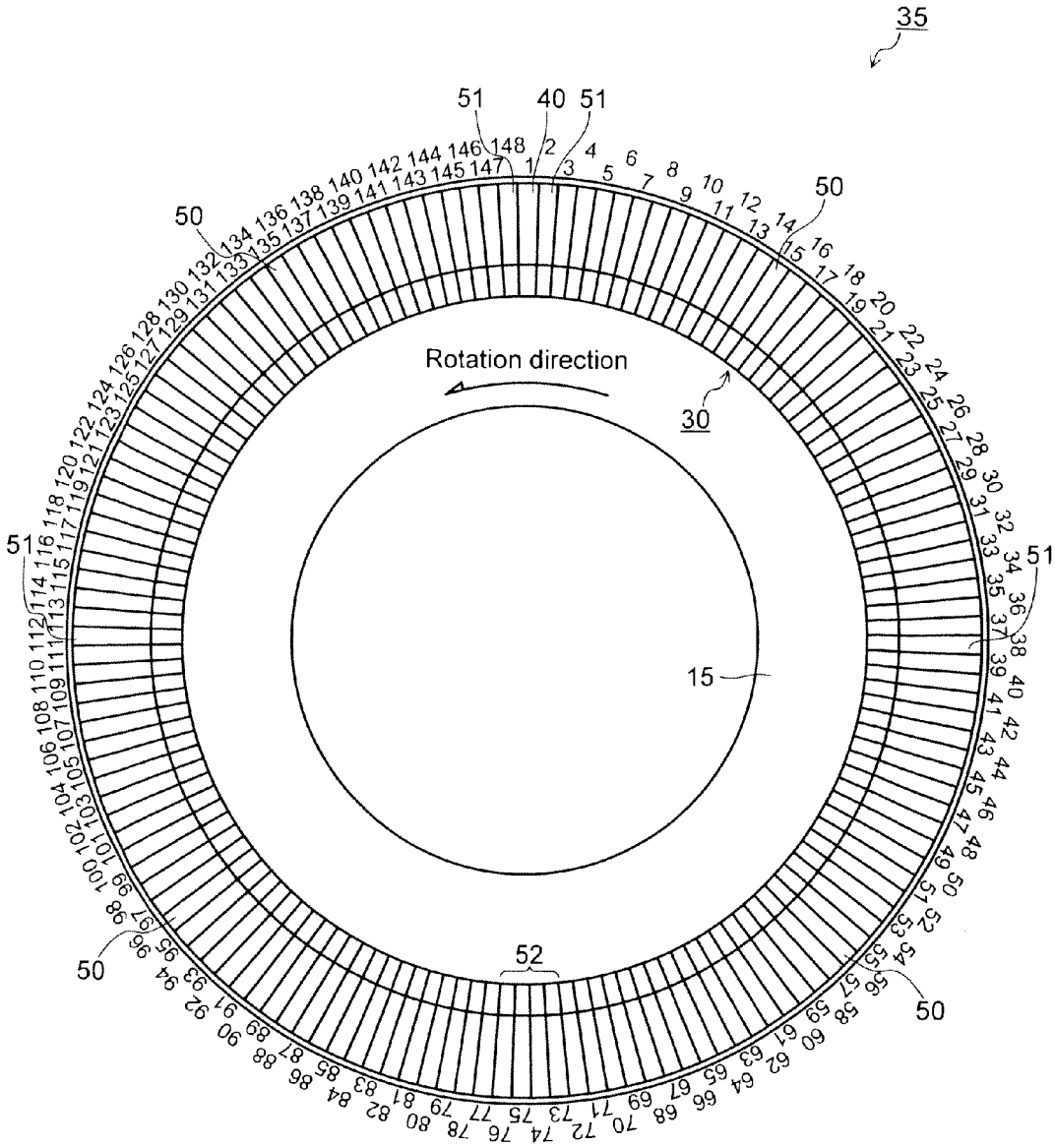
FIG. 7 is a schematic view of the turbine rotor assembly provided with a notch blade instead of the tightening part shown in FIG. 6 according to the first embodiment as viewed from the upstream side in the turbine rotor axial direction.

(2) Use of the Notch Blade 40 as the Tightening Part after a Later Design Change of a Structure Provided with a Stopper Block 60 as the Tightening Part FIG. 6 is a schematic view of the turbine rotor assembly 35 provided with the stopper block 60 as the tightening part of the first embodiment as viewed from the upstream side in a turbine rotor axial direction. FIG. 7 is a schematic view of the turbine rotor assembly 35 provided with the notch blade 40 instead of the tightening part shown in FIG. 6 of the first embodiment as viewed from the upstream side in the turbine rotor axial direction.

An example of using a titanium blade as the notch blade 40 is described below. The notch blade 40 of titanium has the same shape as the notch blade 40 configured of an ordinary material configuring the moving blades described above. And, the titanium notch blade 40 has a weight of about 60% of the weight of the notch blade 40 configured of the ordinary material which is used to form the moving blades.

In the turbine moving blade cascade 30 provided with the stopper block 60 as the tightening part, the weight balance due to the provision of the stopper block 60 is adjusted by replacing some of the regular blades 50 on the counter side of the stopper block 60 by weight-reduced moving blades 70 of which weights are adjusted by forming a groove as shown in FIG. 6. Here, a weight balance-adjusted turbine moving blade cascade 30 having 30 weight-reduced moving blades 70 disposed at portions of Nos. 59 to 88 is shown in the drawing. The weight-reduced moving blades 70 have the same blade width as the blade width N of the regular blade 50.

Described below is the adjustment of the weight balance when the notch blade 40 is provided instead of the stopper block 60 shown in FIG. 6 to configure the turbine moving blade cascade 30 of the first embodiment.

The notch blade 40 is provided instead of the stopper block 60, the 30 weight-reduced moving blades 70 on the counter side of the notch blade 40 are replaced by the regular blades 50, and number b of regular blades among the above regular blades 50 are replaced by narrow blades 52 in order to adjust the weight balance. Then, a relational expression of the weight balance is expressed by the following equation (2). Here, it is also determined for the same reasons as the above-mentioned reasons that the moving blades 13 on both sides of the notch blade 40 are wide blades 51.

$$\text{Weight of notch blade 40} - \text{weight of stopper block 60} + 2\times(\text{weight of wide blades 51} - \text{weight of regular blades } 50\times(1+\Delta L/N)) = \text{weight of regular blades } 50\times(30-b) + (\text{weight of narrow blades 52} + \text{weight of regular blades } 50\times\Delta S/N)\times b \quad (2)$$

In the left-hand side of the equation (2), a weight difference is calculated between a case of configuring by the stopper block 60 and the regular blades 50 on both sides of the stopper block 60 and a case of configuring by the notch blade 40 and the wide blades 51 on both sides of the notch blade 40. In this case, the circumferential blade width of the notch blade 40 and the two wide blades 51 is "C+2×L", namely "C+2×(N+ΔL)", while the circumferential blade width of the stopper block 60 and the two regular blades 50 is "C+2×N". Therefore, when the weight difference is calculated by the left-hand side, the circumferential blade width of the stopper block 60 and the two regular blades 50 is determined to be "C+2×(N+ΔL)" in order to evaluate the blade width in the same circumferential direction. And, the increase of the circumferential blade width is assumed to be an increase of the circumferential blade width of the regular blades 50 to calculate the weight.

In the right-hand side of the equation (2), a weight difference is calculated between a case of configuring the counter side of the notch blade 40 by 30 regular blades 50 instead of the weight-reduced moving blades 70 and a case of configuring the number b of regular blades among the 30 regular blades 50 replaced by the narrow blades 52. When the number b of regular blades among the 30 regular blades 50 are replaced by the narrow blades 52 for configuration, the circumferential blade width is "(30−b)×N+b×(N−ΔS)", and when the 30 regular blades 50 are used for configuration, the circumferential blade width is "30×N". Therefore, when the weight difference is calculated by the right-hand side, the number b of regular blades among the 30 regular blades 50 are replaced by the narrow blades 52 for configuration in order to evaluate by the blade width in the same circumferential direction, the circumferential blade width is determined to be "(30−b)×N+b×(N−ΔS)+b×ΔS", namely "30ΔN". And, the increase of the circumferential blade width is assumed to be an increase of the circumferential width of the regular blade 50 to calculate the weight.

Here, when it is assumed that b is 4 and ΔS is equal to ΔL, four narrow blades 52 (e.g., Nos. 73 to 76) are formed on the counter side of the notch blade 40, and 26 regular blades 50 (e.g., Nos. 60 to 72 and Nos. 77 to 89) are formed on both sides of the narrow blades 52 as shown in FIG. 7. And, a total of four narrow blades 52 are disposed on the circumference of the turbine moving blade cascade 30. Therefore, when four regular blades 50 are replaced by the four narrow blades 52, the circumferential length decreases virtually by "4×ΔS". To compensate the decrease in the circumferential length, the wide blades 51 are used instead of the other regular blades 50. Since it is determined that ΔS is equal to ΔL as described above, four wide blades 51 are arranged on the circumference of the turbine moving blade cascade 30 so that the weight balance is not lost. Since the wide blades 51 are disposed one each on both sides of the notch blade 40, the wide blades 51 are disposed one each at positions (Nos. 112 and 38) of ±90° from the position of the notch blade 40 as shown in FIG. 7.

As described above, when the notch blade 40 is provided instead of the stopper block 60, the weight balance can be adjusted easily by partly replacing the regular blades 50 by the wide blades 51 or the narrow blades 52 without using the weight-reduced moving blades 70. Since the weight-reduced moving blades 70 are not used, the strength can be prevented from degrading. In addition, since the notch blade 40 is used as the tightening part, the stage loss can be suppressed well than when the stopper block 60 is used as the tightening part.

The above-described weight balance adjusting method is one example, and the method is not limited to the example. And, the ΔL/ΔS, the blade width L of the wide blade 51 and the blade width S of the narrow blade 52 are as described above.

As described above, when the wide blades 51 and the narrow blades 52 are used in the turbine moving blade cascade 30 of the turbine rotor assembly 35 of the first embodiment, the structure of the used tightening part is not restricted, and the circumferential width adjustment and the weight balance adjustment can be performed easily without adopting the weight-reduced moving blades or the like. In addition, since the structure of the used tightening part is not restricted, for example, a stage loss due to the tightening part is prevented, and the efficiency can be improved. Besides, since the weight-reduced moving blades or the like are not adopted, the mechanical strength can be maintained, and the reliability of the turbine rotor assembly 35 and, particularly, of the turbine moving blade cascade, can be improved.

And, the circumferential width adjustment and the weight balance adjustment can be made easily by using the wide blades 51 and the narrow blades 52 regardless of whether the notch blade is used as the tightening part from the beginning of the design or the notch blade is used as the tightening part after a later design change of the structure provided with the stopper block as the tightening part.

(Second Embodiment)

A second embodiment describes a turbine rotor assembly 35 provided with a turbine moving blade cascade 30 in that prescribed moving blades can be arranged by moving, for example, in a rotation direction or in a counter-rotation direction of the turbine moving blade cascade 30 within a range of circumferential width of moving blades, a displacement width generated by the movement is compensated by providing the wide blades 51 and the narrow blades 52 in combination, and the weight balance can be adjusted additionally.

For example, when it is desired to displace prescribed moving blades by H(H<N) only in the counter-rotation direction of the turbine moving blade cascade 30, it can be realized by disposing number c of wide blades 51 and number d of narrow blades 52 satisfying the following equation (3) instead of the regular blades 50 between the tightening part and the prescribed moving blades. The numbers c and d are preferably determined so that the quantity of the wide blades 51 and the narrow blades 52 become minimum.

$$H=c\times\Delta L-d\times\Delta S \tag{3}$$

Here, the numbers c and d are natural numbers. The counter side of the positions replaced by the wide blades 51 and the narrow blades 52 in order to adjust the weight balance is replaced by the wide blades 51 and the narrow blades 52 in the same manner as the positions replaced by the wide blades 51 and the narrow blades 52.

Specifically, for example, it can be determined that c is 3 and d is 1 when H is 2.5 mm, ΔL is 1 min and ΔS is 0.5 mm.

Figure 8:
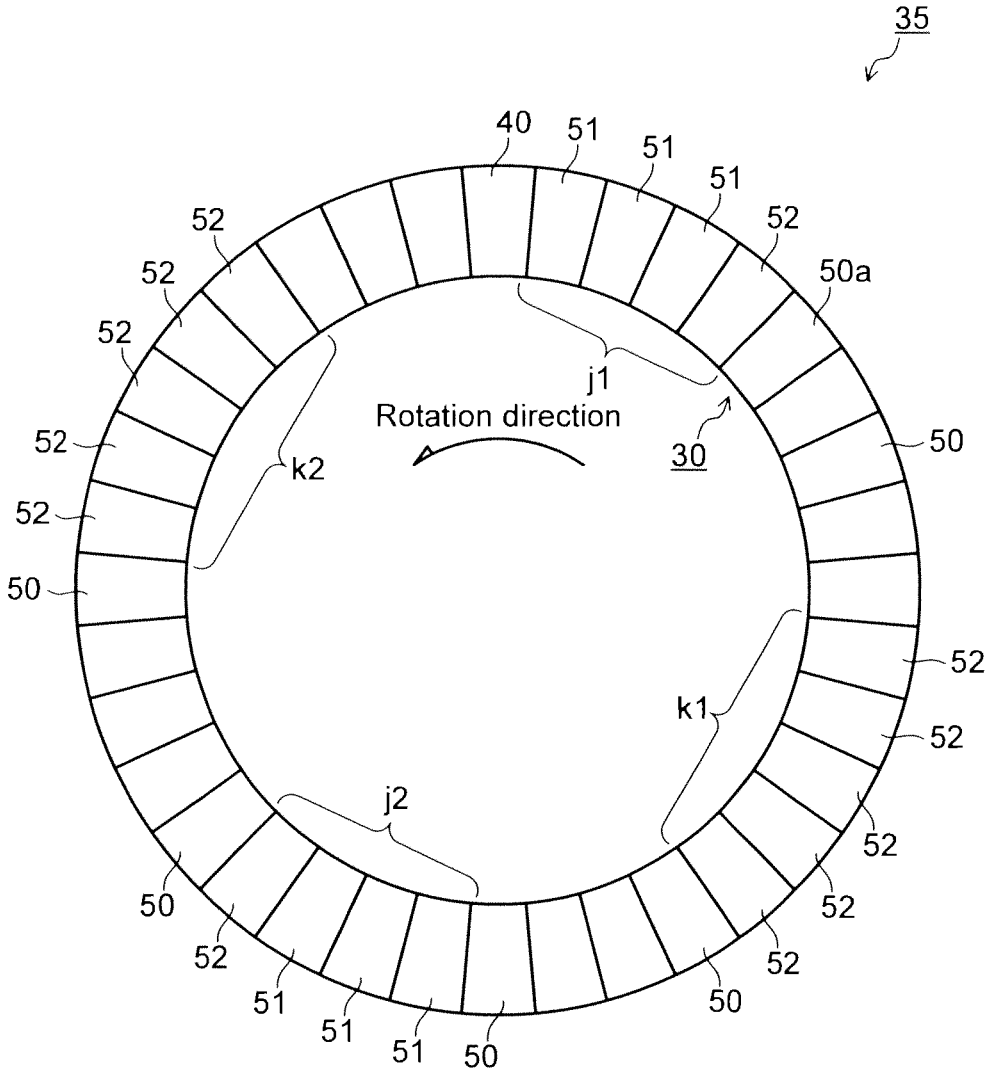
FIG. 8 is a schematic view of a turbine moving blade cascade with a displacement width or the like adjusted by using wide blades and narrow blades when prescribed moving blades (regular blades) are displaced by H(H<N) only in a counter-rotation direction of the turbine moving blade cascade of the turbine rotor assembly according to a second embodiment as viewed from the upstream side in the turbine rotor axial direction.
Figure 9:
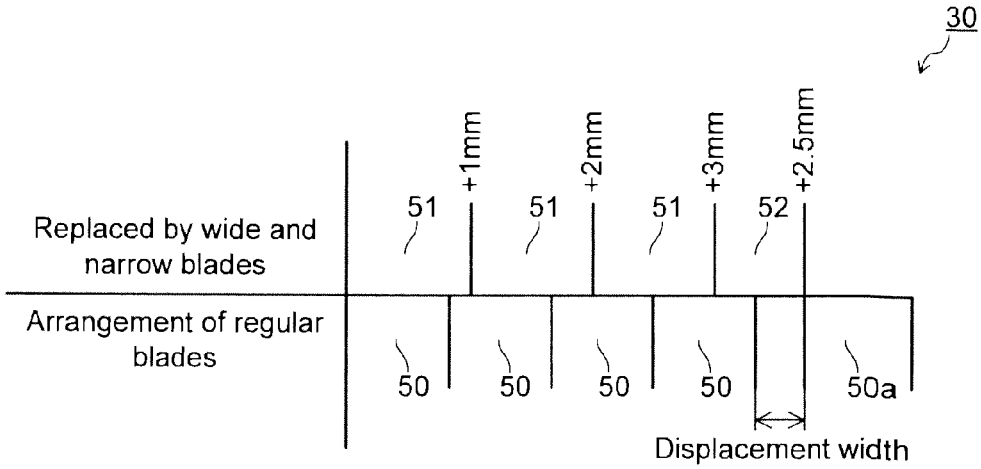
FIG. 9 is a view partly developed of the turbine moving blade cascade of the second embodiment to describe a displacement width developed when prescribed moving blades (regular blades) are displaced by H(H<N) only in a counter-rotation direction of the turbine moving blade cascade in the turbine rotor assembly of the second embodiment.
Figure 10:
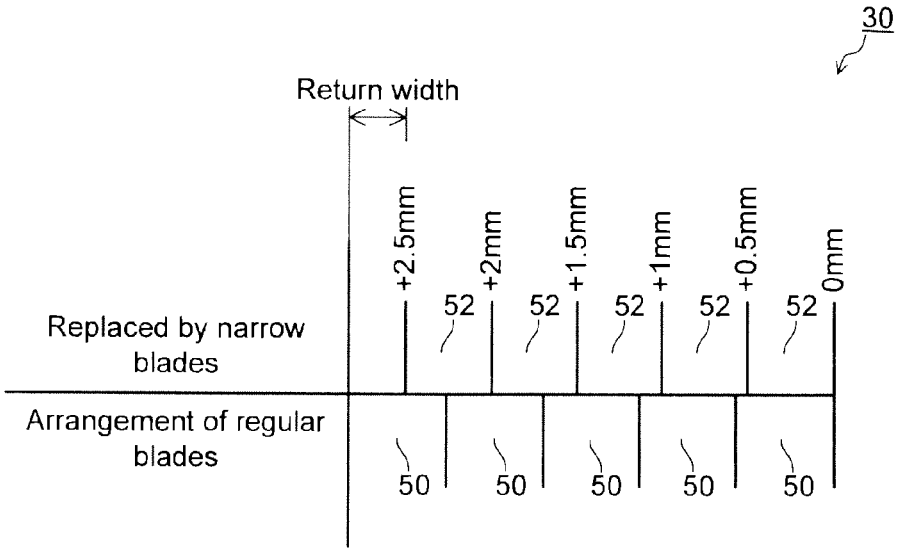
FIG. 10 is a view partly developed of the turbine moving blade cascade of the second embodiment to describe a return width generated when prescribed moving blades (regular blades) are displaced by H(H<N) only in a counter-rotation direction of the turbine moving blade cascade in the turbine rotor assembly of the second embodiment.

FIG. 8 is a schematic view of the turbine moving blade cascade 30 with a displacement width or the like adjusted by using the wide blades 51 and the narrow blades 52 when a prescribed moving blade (regular blade 50*a*) of the turbine rotor assembly 35 of the second embodiment is displaced by H(H<N) only in a counter-rotation direction of the turbine moving blade cascade 30 as viewed from the upstream side in the turbine rotor axial direction. FIG. 9 is a view partly developed of the turbine moving blade cascade 30 in the turbine rotor assembly 35 of the second embodiment to describe the displacement width generated when the prescribed moving blade (regular blade 50*a*) is displaced by H(H<N) only in the counter-rotation direction of the turbine moving blade cascade 30. FIG. 10 is a view partly developed of the turbine moving blade cascade 30 in the turbine rotor assembly 35 of the second embodiment to describe a return width generated when the prescribed moving blade (regular blade 50*a*) is displaced by H(H<N) only in the counter-rotation direction of the turbine moving blade cascade 30.

As shown in FIG. 9, the prescribed moving blade (regular blade 50*a*) can be moved by 2.5 mm in the counter-rotation direction of the turbine moving blade cascade 30 by replacing four regular blades 50 by three wide blades 51 and one narrow blade 52 (j1 group). And, when the prescribed moving blade (regular blade 50*a*) is moved by 2.5 mm in the counter-rotation direction of the turbine moving blade cascade 30, a return width of 2.5 mm generates as shown in FIG. 10. This return width can be remedied by replacing five regular blades 50 by five narrow blades 52. The narrow blades 52 (k1 group) for adjusting the return width are configured at a position of substantially 90 degrees to the counter-rotation direction of the turbine moving blade cascade 30 with respect to the position of the j1 group comprising the three wide blades 51 and the one narrow blade 52 as shown in FIG. 8.

To adjust the weight balance, the wide blades 51 and the narrow blade 52 are disposed in the same structure as the j1 group on the counter side (j2 group) of the j1 group, and the narrow blade 52 is disposed in the same structure as the k1 group on the counter side (k2 group) of the k1 group. Here, the described example shows that the moving blades on one side of the notch blade 40 are configured of the wide blades 51, but the moving blades on both sides of the notch blade 40 may be configured of the wide blade 51. In this case, the wide blades 51 are also arranged on the counter side of the wide blades 51 to adjust the weight balance. Therefore, the circumferential width adjustment and the weight balance adjustment can be performed by replacing the regular blades 50 adjacent to the k1 group and the k2 group by the narrow blades 52.

As a case that the movement of the prescribed moving blades becomes necessary as described above, there is an occurrence of damage to the rotor disk 15 between the moving blades configuring the turbine moving blade cascade 30. The damage is mainly corrosion fatigue resulting from deposition of impurities contained in steam in a gap between the moving blades. If the damage or a sign of the damage is found, the damage or the like is generally removed immediately from the surface of the rotor disk 15 by grinding or the like. And, when the damage size after the removal is small, the position between the moving blades which is the source of the damage is displaced from the original position as described above as an emergency procedure. The turbine moving blade cascade 30 of the turbine rotor assembly 35 according to this embodiment can be applied to the above procedure.

The above-described structure that the prescribed moving blades can be arranged by moving in a circumferential direction by a prescribed width can also be applied to another situation. Another application example is described below.

If the damage on the surface of the rotor disk 15 of the turbine rotor 14 develops, a crack might be formed from a corrosion fatigue mark generated on the outer circumferential surface of the root portion 80 of the rotor disk 15 positioned between, for example, the moving blades. This crack is known to spread substantially in a radial direction toward the inside of the turbine rotor 14 because of high cycle fatigue.

Figure 11:
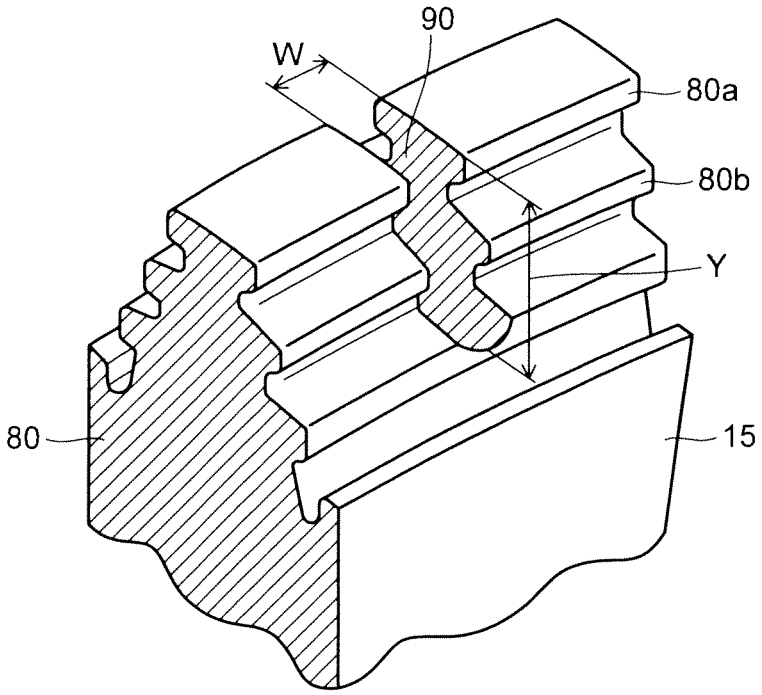
FIG. 11 is a perspective view showing a root portion of a rotor disk with a cut groove formed according to the second embodiment.

FIG. 11 is a perspective view showing the root portion 80 of the rotor disk 15 with a cut groove 90 formed according to the second embodiment. If a crack is caused, it is removed completely by grooving as shown in FIG. 11. The crack does not simply develop in the radial direction only but might develop in a form inclined in the circumferential direction. And, the tip end (groove bottom) of the cut groove 90 formed when repaired by grooving is finished into a rounded shape in order to decrease the stress concentration. Thus, the cut groove 90 becomes a groove having prescribed width W and depth Y as shown in FIG. 11.

The root portion 80 of the rotor disk 15 where the cut groove 90 is formed has a shape that a first hook 80*a* and a second hook 80*b* are partly removed by the cut groove 90 as shown in, for example, FIG. 11. Therefore, when regular blades 50 are used as moving blades which are arranged at the position of the cut groove 90, the centrifugal force of the regular blades 50 must be supported by the partly remaining portions of the root portion 80 other than the cut groove 90, and the stress of the root portion 80 becomes excessively high. Therefore, a repairing moving blade made of, for example, titanium is used as the moving blade arranged at the position of the cut groove 90 to reduce the centrifugal force.

Figure 12:
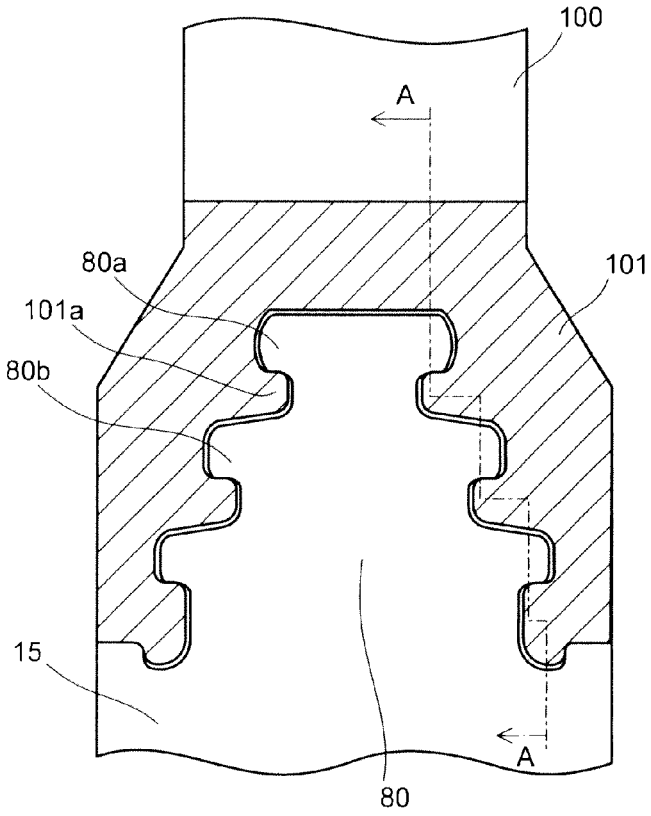
FIG. 12 is a view showing a circumferential cross section of a root portion of a rotor disk with a repairing moving blade implanted according to the second embodiment.
Figure 13:
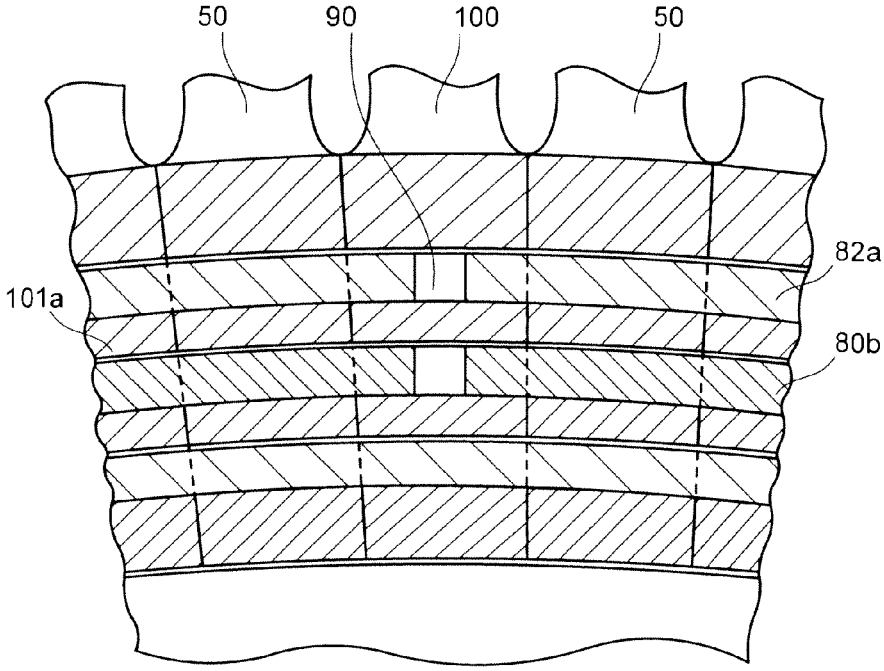
FIG. 13 is a view showing an A-A cross section of FIG. 12.
Figure 14:
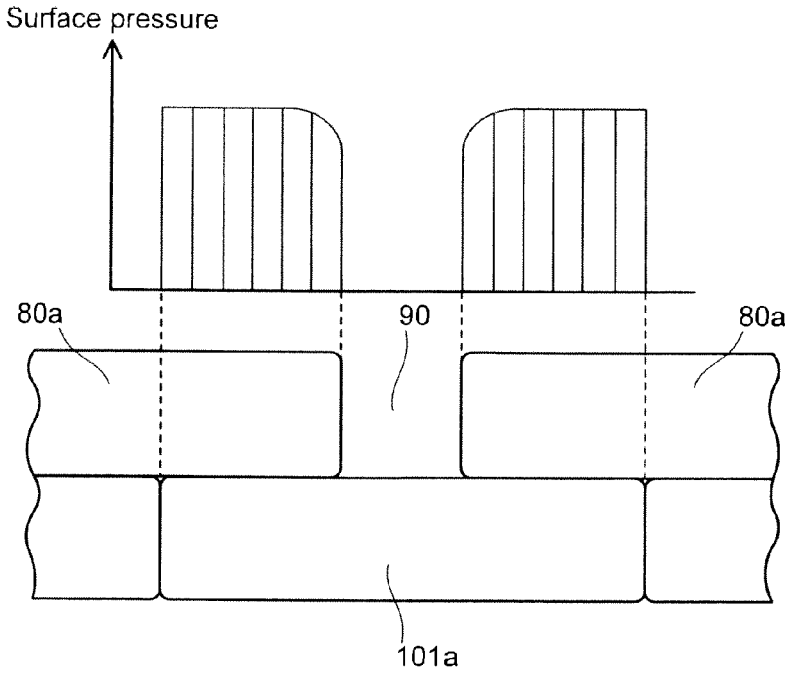
FIG. 14 is a view schematically showing a surface pressure between a first hook of the root portion of the rotor disk and a first hook of the root portion of the repairing moving blade when a cut groove is positioned at the center in the circumferential direction of the root portion of the repairing moving blade according to the second embodiment.
Figure 15:
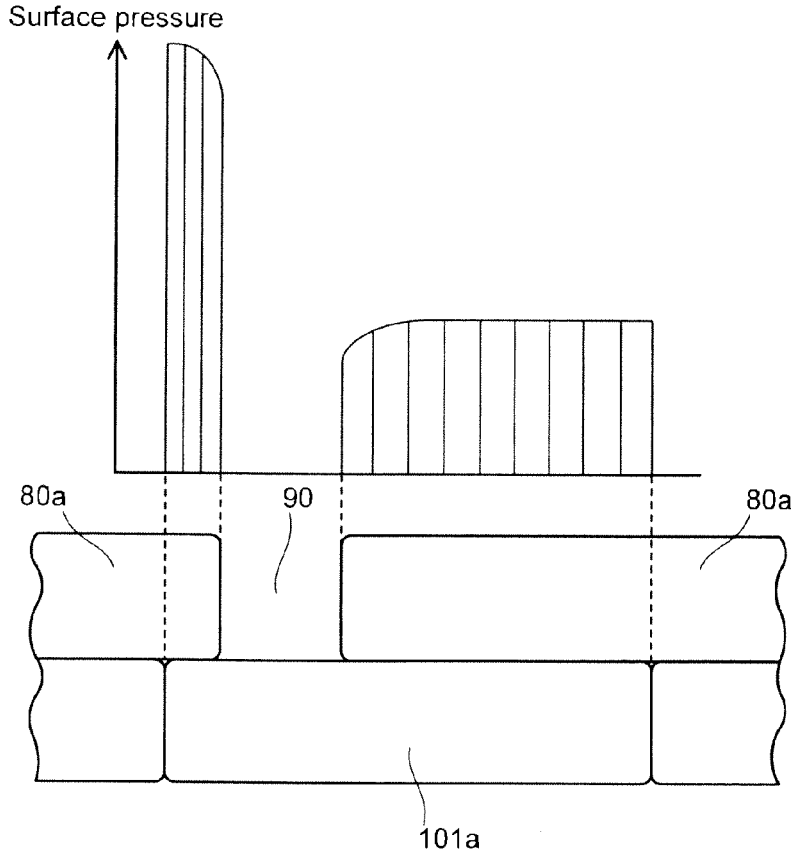
FIG. 15 is a view schematically showing a surface pressure between a first hook of the root portion of the rotor disk and a first hook of the root portion of the repairing moving blade when a cut groove is positioned between a center and an end in the circumferential direction of the root portion of the repairing moving blade according to the second embodiment.
Figure 16:
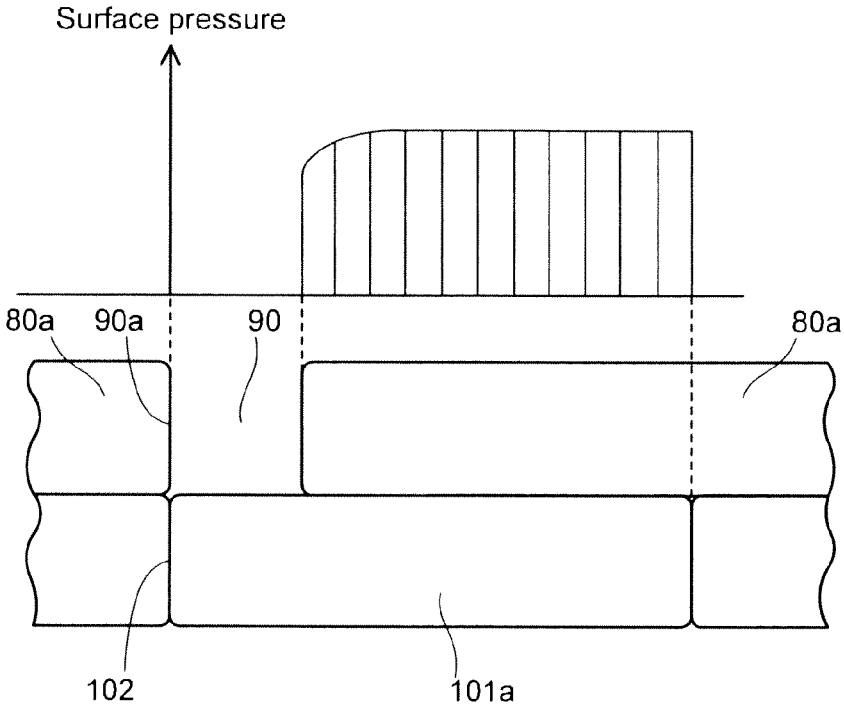
FIG. 16 is a view schematically showing a surface pressure between a first hook of the root portion of the rotor disk and a first hook of the root portion of the repairing moving blade when a cut groove is positioned at a circumferential end of the root portion of the repairing moving blade according to the second embodiment.

FIG. 12 is a view showing a circumferential cross section of the root portion 80 of the rotor disk 15 where a repairing moving blade 100 is implanted according to the second embodiment. FIG. 13 is a view showing an A-A cross section of FIG. 12. FIG. 14 is a view schematically showing a surface pressure between the first hook 80*a* of the root portion 80 of the rotor disk 15 and a first hook 101*a* of a root portion 101 of the repairing moving blade 100 when the cut groove 90 is positioned at the circumferential center of the root portion 101 of the repairing moving blade 100 according to the second embodiment. FIG. 15 is a view schematically showing a surface pressure between the first hook 80*a* of the root portion 80 of the rotor disk 15 and the first hook 101*a* of the root portion 101 of the repairing moving blade 100 when the cut groove 90 is positioned between a center and an end in the circumferential direction of the root portion 101 of the repairing moving blade 100 according to the second embodiment. FIG. 16 is a view schematically showing a surface pressure between the first hook 80*a* of the root portion 80 of the rotor disk 15 and the first hook 101*a* of the root portion 101 of the repairing moving blade 100 when the cut groove 90 is positioned at the circumferential end of the root portion 101 of the repairing moving blade 100 according to the second embodiment.

The surface pressures each are obtained by dividing a reactive force acting on the hook by a pressure-receiving area, but for one moving blade, the reactive forces acting on individual hook portions are calculated from a condition that the moments due to operation reactive forces of the individual portions are balanced.

As shown in FIG. 14, when the cut groove 90 is positioned at the circumferential center of the root portion 101 of the repairing moving blade 100, the surface pressures generated on both sides of the cut groove 90 are substantially equal to each other and have the same pressure distribution. Here, when the cut groove 90 is positioned at the center of the root portion 101 of the repairing moving blade 100, it indicates that the repairing moving blade 100 is arranged so that the circumferential center of the root portion 101 of the repairing moving blade 100 is positioned at a position corresponding to the circumferential center of the cut groove 90 (see FIG. 13).

As shown in FIG. 15, when the cut groove 90 is positioned between a center and an end in the circumferential direction of the root portion 101 of the repairing moving blade 100, the surface pressure on the side (right side in FIG. 15) having a large contact area with the first hook 80*a* is low and substantially uniform, while the surface pressure on the side (left side in FIG. 15) having a small contact area with the first hook 80*a* becomes high. This tendency becomes conspicuous as the contact area decreases on the side (left side in FIG. 15) having a small contact area with the first hook 80*a*. Here, when the cut groove 90 is positioned between the center and the end in the circumferential direction of the root portion 101 of the repairing moving blade 100, it indicates that the repairing moving blade 100 is arranged so that the cut groove 90 corresponding to the circumferential center is positioned on the end side of the root portion 101 of the repairing moving blade 100 rather than at the circumferential center of the root portion 101 of the repairing moving blade 100.

Figure 17:
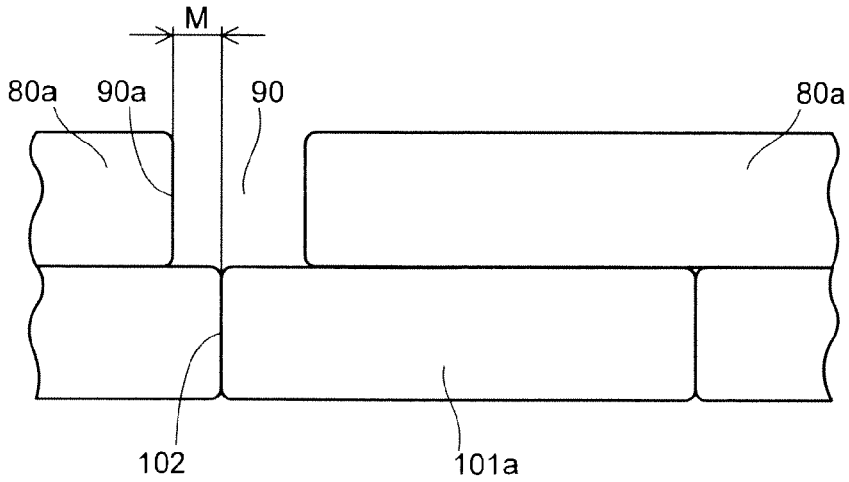
FIG. 17 is a view showing a circumferential distance M between one circumferential end of the root portion of the repairing moving blade and one circumferential end of the cut groove according to the second embodiment.

As shown in FIG. 16, when the cut groove 90 is positioned at a circumferential end of the root portion 101 of the repairing moving blade 100, one end 102 of the first hook 101*a* of the root portion 101 of the repairing moving blade 100 does not come into contact with the first hook 80*a*, so that a surface pressure is not applied. Meanwhile, the surface pressure of a portion in contact with the first hook 80*a* shows a substantially uniform distribution. Here, when the cut groove 90 is positioned at the circumferential end of the root portion 101 of the repairing moving blade 100, it indicates that the repairing moving blade 100 is arranged so that the one end 102 in the circumferential direction of the root portion 101 of the repairing moving blade 100 is positioned at a position corresponding to one end 90*a* in the circumferential direction of the cut groove 90. The one end 102 in the circumferential direction of the root portion 101 of the repairing moving blade 100 in contact with the root portion of the adjacent moving blades may be positioned within a circumferential range where the cut groove 90 is formed. FIG. 17 is a view showing a circumferential distance M between the one end 102 in the circumferential direction of the root portion 101 of the repairing moving blade 100 and the one end 90*a* in the circumferential direction of the cut groove 90 according to the second embodiment. Here, the surface pressure of the first hook 80*a* increases to (N/(N−M)) time, so that M is preferably small. Considering the tolerance to the position at the time of assembling, it is practical to determine that the circumferential distance M between the one end 102 in the circumferential direction of the root portion 101 of the repairing moving blade 100 and the one end 90*a* in the circumferential direction of the cut groove 90 is 2 mm or less.

Considering the above-described surface pressure distribution, it is preferable to arrange the repairing moving blade 100 so that the surface pressure distribution shown in FIG. 14 or FIG. 16 can be obtained. That is, as shown in FIG. 14, it is preferable to arrange the moving blade so that the circumferential center of the moving blade (repairing moving blade 100 here) is positioned at a position corresponding to the circumferential center of the cut groove 90. As shown in FIG. 16 or FIG. 17, it is preferable that the root portions of the neighboring moving blades (e.g., the repairing moving blade 100 and the wide blade 51) are arranged to contact mutually within a circumferential range that the cut groove 90 is formed. By arranging the repairing moving blade 100 as described above, the most stable repair can be performed in view of the stress.

When the repairing moving blade 100 is arranged to obtain the surface pressure distribution shown in FIG. 14 or FIG. 16, the wide blade 51 or the narrow blade 52 is used to adjust the weight balance, but it is more preferable that the repairing moving blade 100 is arranged to obtain the surface pressure distribution shown in FIG. 16 so that the used number of the moving blades is decreased as small as possible. The used number of the wide blades 51 or the narrow blades 52 can be decreased by adopting the arrangement of the repairing moving blade 100 shown in FIG. 16 because the displacement width described with reference to FIG. 9 can be suppressed small.

Here, described below is the adjustment of the weight balance when the repairing moving blade 100 is arranged so that the surface pressure distribution shown in FIG. 16 can be obtained.

Figure 18:
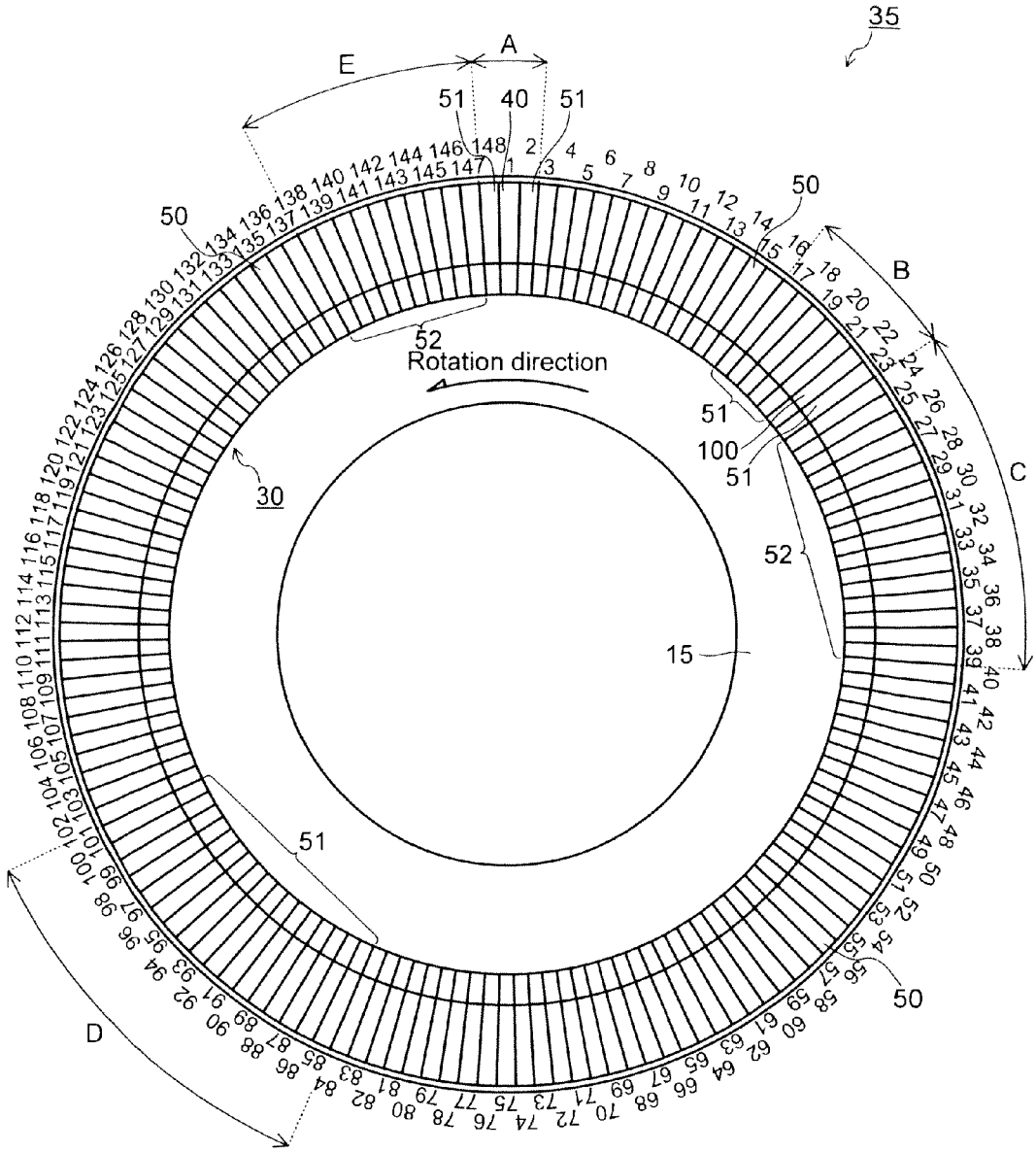
FIG. 18 is a schematic view of a turbine rotor assembly provided with the repairing moving blade in a turbine moving blade cascade according to the second embodiment as viewed from the upstream side in the turbine rotor axial direction.
Figure 19:
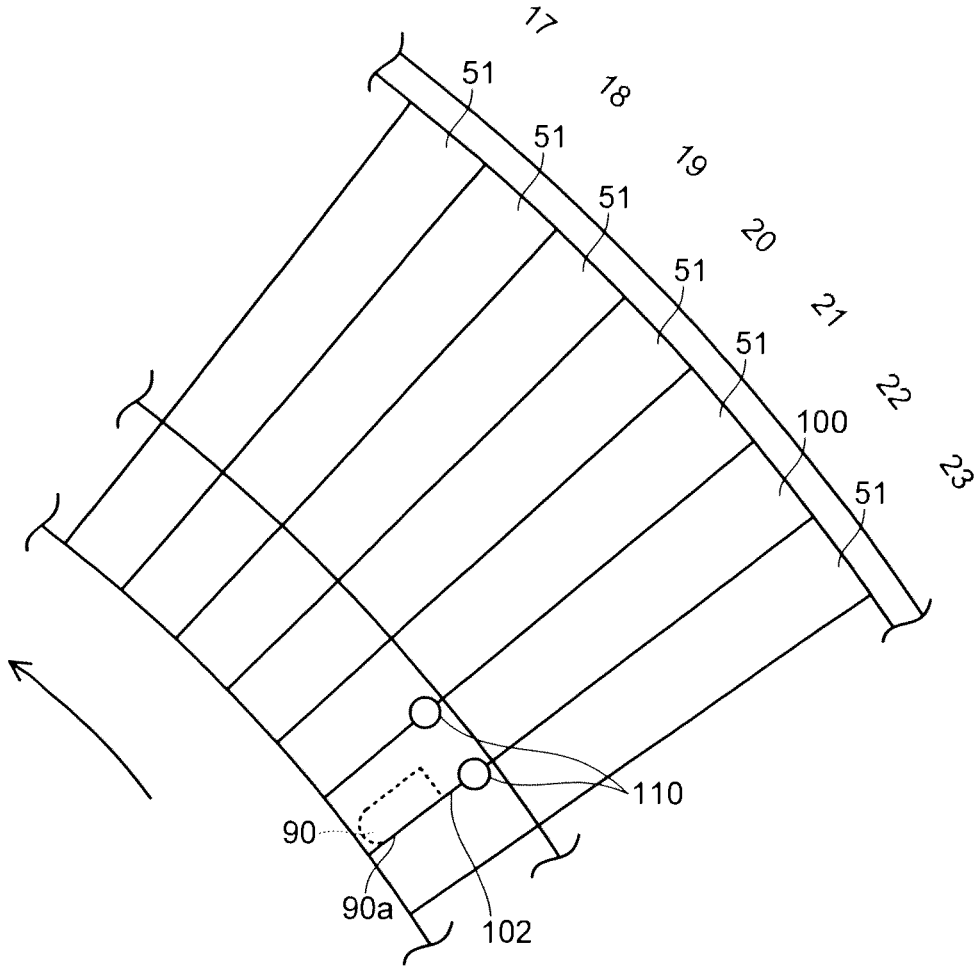
FIG. 19 is a magnified view of a region where the repairing moving blade of FIG. 18 is arranged.

FIG. 18 is a schematic view of the turbine rotor assembly 35 provided with the repairing moving blade 100 in the turbine moving blade cascade 30 according to the second embodiment as viewed from the upstream side in the turbine rotor axial direction. FIG. 19 is a magnified view of the region where the repairing moving blade 100 of FIG. 18 is arranged.

FIG. 18 shows a case that a cut groove 90 is on a halfway around in the counter-rotation direction from the notch blade 40. And, the wide blade 51 is arranged on both sides of the notch blade 40, and the notch blade 40 is fixed to the wide blades 51 by the same manner as the previously described fixing method.

As shown in FIG. 19, the repairing moving blade 100 (No. 22) is arranged so that the one end 102 (end in the counter-rotation direction) in the circumferential direction of the root portion 101 of the repairing moving blade 100 is positioned at a position corresponding to one end 90*a* (end in the counter-rotation direction) in the circumferential direction of the cut groove 90. The repairing moving blade 100 is also fixed by the keys 110 to the wide blades 51 arranged on both sides in the same manner as the above-described notch blade 40.

An example of the method to configure the turbine moving blade cascade 30 when the repairing moving blade 100 is arranged as described above is described below. Here, described below is a case that the repairing moving blade 100 of titanium is used, and the blade width of the repairing moving blade 100 is equal to the blade width L of the wide blade 51.

First, the position where the repairing moving blade 100 is arranged is determined. Here, the repairing moving blade 100 (No. 22) is arranged so that the one end 102 (end in the counter-rotation direction) in the circumferential direction of the root portion 101 of the repairing moving blade 100 is positioned at the position corresponding to the one end 90*a* (end in the counter-rotation direction) in the circumferential direction of the cut groove 90 as described above.

Subsequently, the regular blades 50 are arranged in the counter-rotation direction between the notch blade 40 and the repairing moving blade 100. If the position adjustment in the circumferential direction cannot be made by the arrangement of the regular blades 50, the wide blade 51 or the narrow blade 52 is used to adjust the positions of the moving blades between the notch blade 40 and the repairing moving blade 100. Here, five wide blades 51 are used to adjust the positions of the moving blades between the notch blade 40 and the repairing moving blade 100 as shown in FIG. 18 and FIG. 19. The portions where the five wide blades 51, the repairing moving blade 100 and the wide blade 51 on one side of the repairing moving blade 100 are arranged is called a portion B.

Here, the wide blade 51 arranged on the counter-rotation direction side of the notch blade 40 and the repairing moving blade 100 having the same blade width as the wide blade 51 are provided, so that it is equivalent to the use of a total of seven wide blades 51 between the notch blade 40 and the repairing moving blade 100 from a viewpoint of the blade width. It is also equivalent to the use of eight wide blades 51 including the wide blade 51 on the counter-rotation direction side of the repairing moving blade 100. Therefore, it is necessary to use the narrow blades 52 to cancel out the increase in the circumferential width generated because of the provision of the wide blades 51. Here, the wide blades 51 and the narrow blades 52 are configured so that $\Delta L$ and $\Delta S$ become equal to each other. It is determined here that the repairing moving blade 100 has the same blade width as the blade width L of the wide blade 51, but for example, the blade width of the repairing moving blade 100 may be made equal to the blade width N of the regular blade 50 or the blade width S of the narrow blade 52 depending on the width W of the cut groove 90.

After the arrangement between the notch blade 40 and the repairing moving blade 100 is determined, plural narrow blades 52 are arranged on the counter-rotation direction side adjacent to the B portion to compensate for the weight of the weight-reduced B portion and to cancel out the increase in the circumferential width due to the wide blades 51 used so far. The portion where the narrow blades 52 are arranged is called as a C portion.

Subsequently, plural narrow blades 52 are arranged on the rotation direction side adjacent to the portion configuring the A portion comprising the notch blade 40 and the wide blades 51 arranged on both sides of the notch blade 40, to compensate the weight of the weight-reduced A portion and also to cancel out the increase of the circumferential width due to the wide blades 51 arranged on the rotation direction side of the notch blade 40. The portion where the narrow blades 52 are arranged is called as an E portion.

Subsequently, plural wide blades 51 are arranged at the portions which are on the counter side of the above portions to adjust the weight balance with the A portion, the B portion, the C portion and the E portion and to make the final adjustment of the circumferential length. The portion where the wide blades 51 are arranged is called a D portion.

Thus, the turbine moving blade cascade 30 provided with the repairing moving blade 100 is configured as shown in FIG. 18. The portions other than the notch blade 40, the wide blades 51 and the narrow blades 52 are comprised of the regular blades 50.

Figure 20:
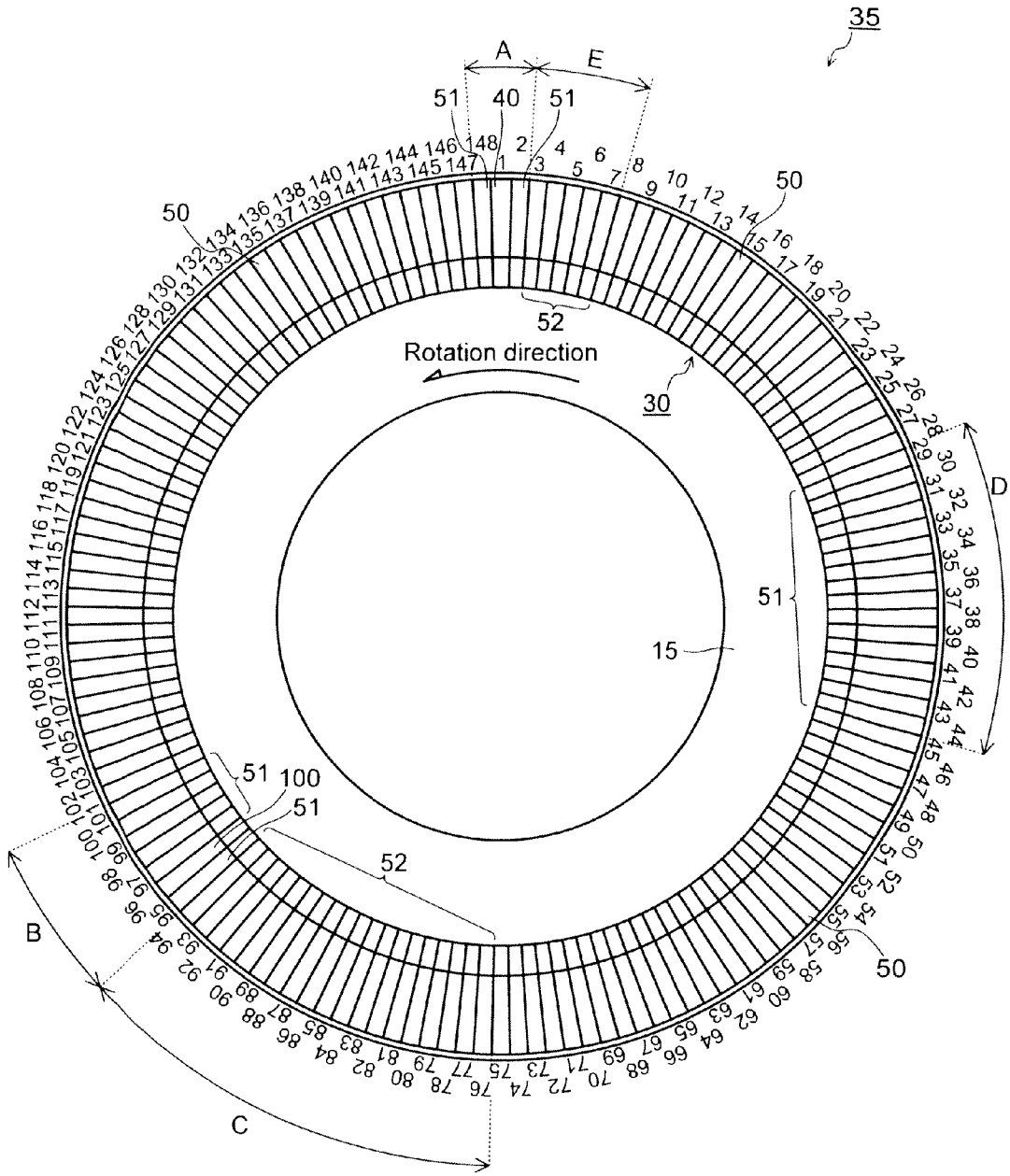
FIG. 20 is a schematic view of the turbine rotor assembly provided with the repairing moving blade in the turbine moving blade cascade according to the second embodiment as viewed from the upstream side in the turbine rotor axial direction.
Figure 21:
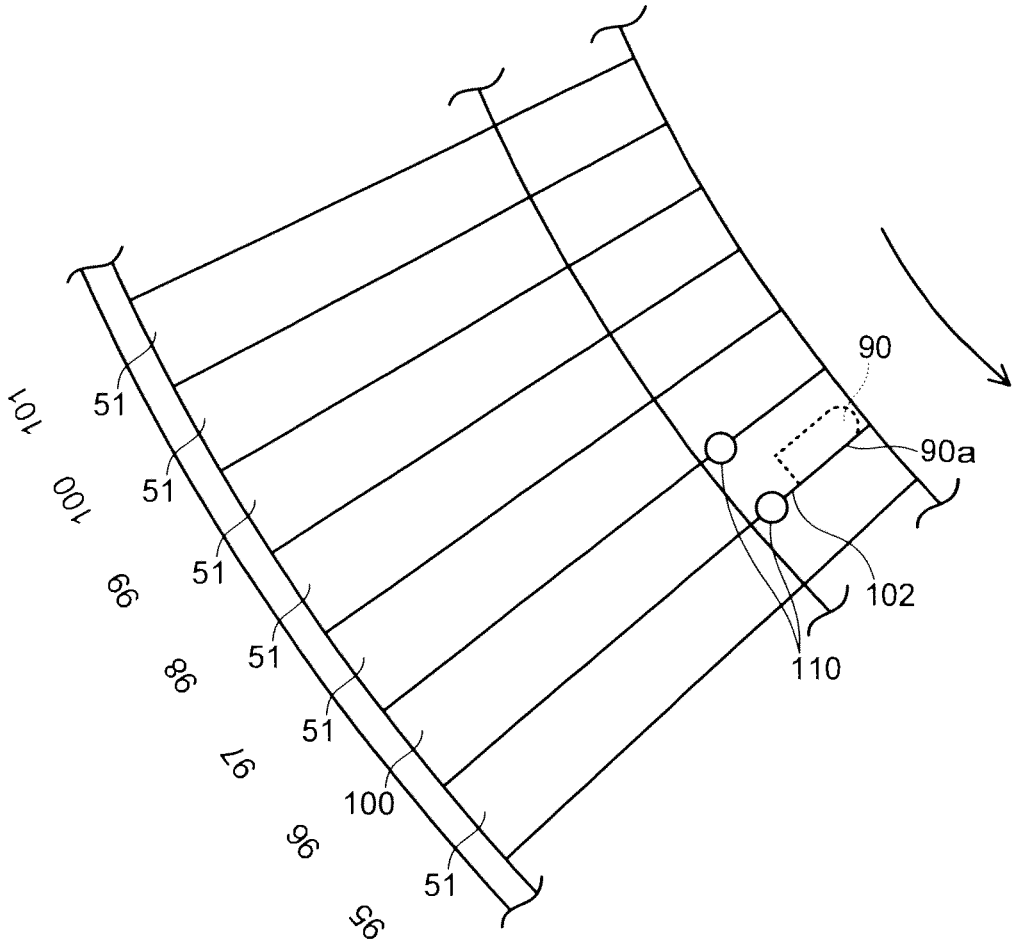
FIG. 21 is a magnified view of a region where the repairing moving blade of FIG. 20 is arranged.
Figure 22:
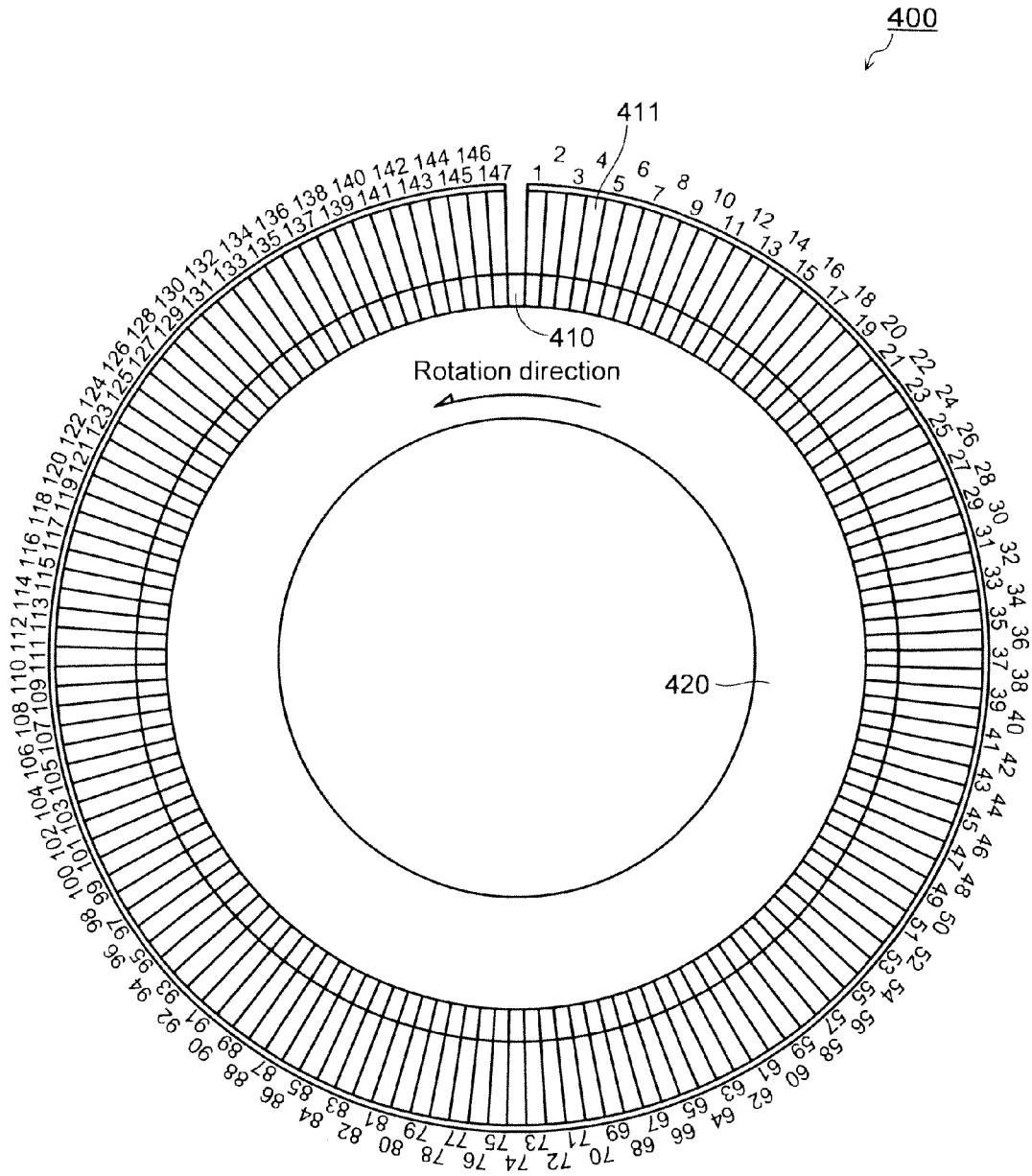
FIG. 22 is a schematic view of a conventional turbine moving blade cascade having a stopper block as a tightening part as viewed from the upstream side in the turbine rotor axial direction.
Figure 23:
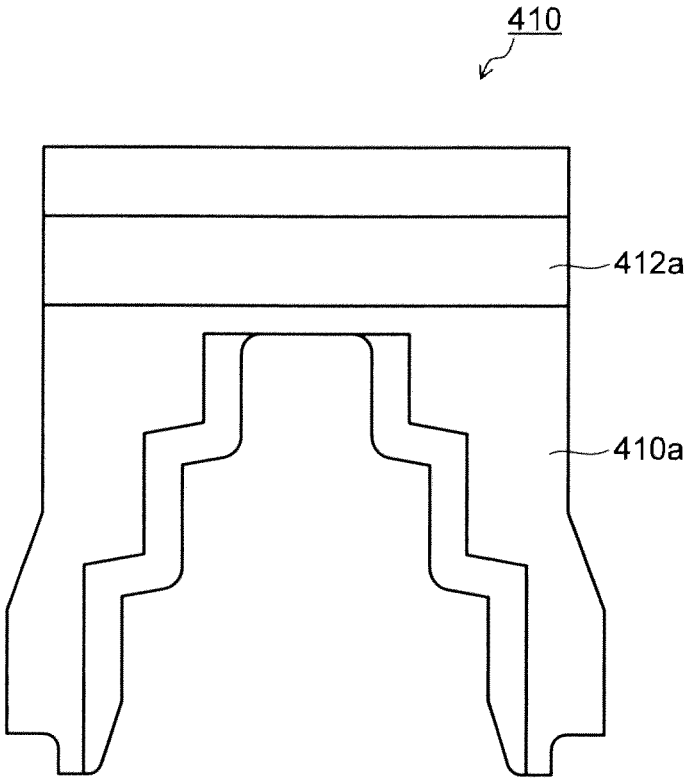
FIG. 23 is a plan view of a conventional stopper block viewed from its circumferential direction.

FIG. 20 is a schematic view of the turbine rotor assembly 35 provided with the repairing moving blade 100 in the turbine moving blade cascade 30 according to the second embodiment as viewed from the upstream side in the turbine rotor axial direction. FIG. 21 is a magnified view of the region where the repairing moving blade 100 of FIG. 20 is arranged.

FIG. 20 and FIG. 21 show a case that a cut groove 90 is on a halfway around in the rotation direction from the notch blade 40. And, the wide blade 51 is arranged on both sides of the notch blade 40, and the notch blade 40 is fixed to the wide blades 51 by the same method as the previously described fixing method.

As shown in FIG. 21, a repairing moving blade 100 (No. 96) is arranged so that one end 102 (end in the rotation direction) in the circumferential direction of the root portion 101 of the repairing moving blade 100 is positioned at a position corresponding to one end 90*a* (end in the rotation direction) in the circumferential direction of the cut groove 90. And, the repairing moving blade 100 is fixed to the wide blades 51 arranged on its both sides by the keys 110 in the same manner as the above-described notch blade 40.

When the cut groove 90 is on a halfway around in the rotation direction from the notch blade 40, the turbine moving blade cascade 30 provided with the repairing moving blade 100 is configured by the same method as the above-described case in that the cut groove 90 is on the halfway around in the counter-rotation direction from the notch blade 40.

For example, when there is damage to the surface of the rotor disk 15 of the turbine rotor 14 in the turbine rotor assembly 35 of the second embodiment as described above, prescribed moving blades are moved by using the wide blades 51 and the narrow blades 52 in the turbine moving blade cascade 30, so that it can be configured not to expose the damage to steam. Thus, the safety of the steam turbine can be improved.

Even when the root portion 80 of the rotor disk 15 is provided with the cut groove 90 which is formed to remove the crack and the repairing moving blade 100 of titanium is arranged at, for example, a portion corresponding to the cut groove 90, the circumferential width adjustment and the weight balance adjustment can be performed easily by using the wide blades 51 and the narrow blades 52. Since the arranged position of the repairing moving blade 100 with respect to the cut groove 90 can be adjusted, a stress applied to, for example, the first hook 80*a* of the root portion 80 of the rotor disk 15 or the first hook 101*a* of the root portion 101 of the repairing moving blade 100 can be made uniform.

The turbine rotor assemblies described in the above embodiments are just examples and not limited to the above structures. That is, the turbine rotor assembly having the turbine moving blade cascade, in which the circumferential width adjustment and the weight balance adjustment are performed by using the wide blades 51 and the narrow blades 52 without using weight-reduced moving blades, is included in the turbine rotor assembly of the embodiments.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A turbine rotor assembly, comprising:

a turbine rotor;

a root groove circumferentially provided around an outer circumferential surface of the turbine rotor; and a plurality of moving blades, each of which comprising a root member coupled with the root groove, wherein the moving blades comprise:

a regular blade, the root member of which has a circumferential width determined based upon a circumferential length of the outer surface of the turbine rotor and a number of the moving blades coupled with the root groove;

a wide blade, the root member of which has a circumferential width wider than the regular blade; and a narrow blade, the root member of which has a circumferential width narrower than the regular blade.

2. The turbine rotor assembly according to claim 1, wherein a difference of the circumferential width of the root members between the wide blade and the regular blade is configured to be defined as $\Delta L$;

wherein a difference of the circumferential width of the root members between the regular blade and the narrow blade is configured to be defined as $\Delta S$; and wherein a value obtained by a formula ($\Delta L/\Delta S$) is set to be a natural number.

3. The turbine rotor assembly according to claim 1, wherein the moving blades comprise a notch blade that is lastly inserted into the root groove between the moving blades; and wherein the wide blades are arranged at circumferential both sides of the notch blade.

4. The turbine rotor assembly according to claim 1, wherein the turbine rotor comprises:

a turbine shaft; and a turbine disk coupled with an outer circumferential surface of the turbine shaft, wherein the root groove is provided at an outer circumferential surface of the turbine disk;

wherein the turbine disk comprises a cut groove formed at the outer circumferential surface of the turbine disk; and wherein a circumferential center of the root member of the moving blade is located at a circumferential center of the cut groove, at a radial outside of the cut groove.

5. The turbine rotor assembly according to claim 1, wherein the turbine rotor comprises:

a turbine shaft; and a turbine disk coupled with an outer circumferential surface of the turbine shaft;

wherein the root groove is provided at an outer circumferential surface of the turbine disk;

wherein the turbine disk comprises a cut groove formed at the outer circumferential surface of the turbine disk; and wherein a circumferential end of the root member of one of the moving blades is located at a radial outside of the cut groove.

6. A steam turbine comprising:

a casing; and the turbine rotor assembly according to claim 1, rotatably coupled with the casing.

* * * * *